US007237368B2

(12) United States Patent
Richardson et al.

(10) Patent No.: US 7,237,368 B2
(45) Date of Patent: Jul. 3, 2007

(54) ADJUSTABLE ANCHORING SYSTEM FOR A WALL

(75) Inventors: Richard B. Richardson, 1850 Park Ave. North, Winter Park, FL (US) 32789; John E. Nemazi, Bloomfield Hills, MI (US)

(73) Assignee: Richard B. Richardson, Winter Park, FL (US)

( * ) Notice: Subject to any disclaimer, the term of this patent is extended or adjusted under 35 U.S.C. 154(b) by 712 days.

(21) Appl. No.: 10/154,952

(22) Filed: May 24, 2002

(65) Prior Publication Data

US 2003/0217521 A1 Nov. 27, 2003

(51) Int. Cl.

| | |
|---|---|
| ***E04B 1/38*** | (2006.01) |
| ***E04B 7/04*** | (2006.01) |
| ***E04C 5/00*** | (2006.01) |
| ***E02D 27/00*** | (2006.01) |
| ***E02D 27/32*** | (2006.01) |

(52) U.S. Cl. ..... 52/707; 52/92.2; 52/92.1; 52/710; 52/295; 52/698; 52/704

(58) Field of Classification Search ..... 52/92.2, 52/92.1, 707, 295, 698, 704, 93.2, 713, 699, 52/91.2, 710

See application file for complete search history.

(56) References Cited

U.S. PATENT DOCUMENTS

| | | | | | |
|---|---|---|---|---|---|
| 1,115,243 | A | * | 10/1914 | Jordahl | 241/82.4 |
| 1,588,628 | A | * | 6/1926 | Sellers | 52/709 |
| 1,657,441 | A | * | 1/1928 | Gottfried | 52/293.2 |
| 1,708,091 | A | * | 4/1929 | Healy | 52/709 |
| 1,850,276 | A | | 3/1932 | Zifferer | |
| 1,929,835 | A | * | 10/1933 | Awbrey | 52/709 |
| 1,988,124 | A | * | 1/1935 | Johnson | 52/710 |
| 2,396,826 | A | * | 3/1946 | Callan | 138/39 |
| 2,396,828 | A | * | 3/1946 | Carpenter | 52/92.3 |
| 2,947,119 | A | * | 8/1960 | Puckett, Jr. | 52/699 |
| 2,953,874 | A | | 9/1960 | Kindorf | |
| 3,266,202 | A | * | 8/1966 | Furer | 52/39 |
| 3,565,385 | A | * | 2/1971 | Zurawski | 248/343 |
| 3,601,347 | A | * | 8/1971 | Attwood et al. | 248/242 |
| 3,606,418 | A | * | 9/1971 | Buker et al. | 403/363 |
| 3,727,355 | A | * | 4/1973 | Vachon | 52/82 |
| 3,877,275 | A | | 4/1975 | Attwood | |
| 3,994,111 | A | * | 11/1976 | Papayoti | 52/650.3 |

(Continued)

OTHER PUBLICATIONS

Simpson Strong Tie Connectors, pp. 58-59, Copyright 1993.

(Continued)

*Primary Examiner*—Carl D. Friedman
*Assistant Examiner*—Hunter Dreidame
(74) *Attorney, Agent, or Firm*—Brooks Kushman P.C.

(57) ABSTRACT

An anchor system for attaching a series of structural members to a wall comprises an elongate horizontal track and a plurality of anchor plates. The horizontal track has a pair of spaced apart sidewalls defining therebetween an upwardly facing channel with a restricted opening. The anchor plates each include an enlarged head portion, nailing plate and a relatively narrow strap extending between the head portion and the nailing plate. The head portion is sized to fit within the channel and engage the sidewalls to retain the anchor plates at selected longitudinal positions. The strap is sized to pass between the sidewalls to position the nailing plate normal to the track for attaching a structural member thereto.

28 Claims, 20 Drawing Sheets

U.S. PATENT DOCUMENTS

| | | | | | |
|---|---|---|---|---|---|
| 4,014,151 | A | * | 3/1977 | Erhart | 52/166 |
| 4,027,711 | A | | 6/1977 | Tummarello | |
| 4,073,114 | A | | 2/1978 | Irish | |
| 4,085,556 | A | * | 4/1978 | Sonneville | 52/223.13 |
| 4,130,977 | A | * | 12/1978 | Taylor et al. | 52/710 |
| 4,291,996 | A | | 9/1981 | Gilb | |
| 4,365,744 | A | * | 12/1982 | Moehren | 238/323 |
| 4,480,941 | A | | 11/1984 | Gilb et al. | |
| 4,523,417 | A | * | 6/1985 | Beastall et al. | 52/273 |
| 4,569,167 | A | * | 2/1986 | Staples | 52/92.2 |
| 4,714,372 | A | | 12/1987 | Commins | |
| 4,733,986 | A | * | 3/1988 | Kenning et al. | 403/306 |
| 4,819,390 | A | * | 4/1989 | Capper et al. | 52/95 |
| 4,826,078 | A | * | 5/1989 | Arvin et al. | 238/14.14 |
| 4,946,099 | A | * | 8/1990 | Bratchell | 238/264 |
| 4,961,553 | A | * | 10/1990 | Todd | 248/62 |
| 5,002,436 | A | * | 3/1991 | Sigourney | 405/262 |
| 5,083,706 | A | * | 1/1992 | Bratchell | 238/265 |
| 5,165,628 | A | * | 11/1992 | Todd et al. | 248/62 |
| 5,335,470 | A | * | 8/1994 | Alvarez | 52/699 |
| 5,357,721 | A | * | 10/1994 | Alvarez | 52/92.2 |
| 5,370,577 | A | * | 12/1994 | Jonett et al. | 454/260 |
| 5,442,887 | A | * | 8/1995 | Welsh | 52/92.2 |
| 5,640,822 | A | * | 6/1997 | Haswell | 52/712 |
| 5,699,639 | A | * | 12/1997 | Fernandez | 52/707 |
| 5,732,524 | A | * | 3/1998 | Kalker et al. | 52/712 |
| 5,809,703 | A | | 9/1998 | Kelly | |
| 5,823,727 | A | * | 10/1998 | Lee | 411/85 |
| 6,073,404 | A | * | 6/2000 | Norfleet | 52/236.3 |
| 6,151,843 | A | | 11/2000 | Weaver et al. | |
| 6,334,285 | B1 | * | 1/2002 | Kirschner | 52/702 |
| 6,341,466 | B1 | * | 1/2002 | Kehoe et al. | 52/712 |
| 6,598,363 | B1 | * | 7/2003 | Ferguson et al. | 52/272 |
| 6,662,517 | B1 | * | 12/2003 | Thompson | 52/714 |

OTHER PUBLICATIONS

B-Line Strut Systems, Engineering Catalog, 1985, pp. 2, 150-157.
Unistrut General Engineering Catalog, Unistrut All Purpose Metal Framing, 1988, pp. 54-57 and 77-82, vol. 11.

* cited by examiner

ADJUSTABLE ANCHORING SYSTEM FOR A WALL

BACKGROUND OF THE INVENTION

1. Field of the Invention

The present invention relates to building construction, and the like, more particularly to an adjustable system for anchoring structural members to walls.

2. Background Art

It is well known in the art that codes and specifications are established for building construction for ensuring that buildings are constructed to withstand the loads and pressures that may be applied. Not only are builders governed by these regulations, it is advantageous to a builder to construct quality homes and buildings that withstand extreme conditions, to benefit the builder's repute and minimize liability. Attachment of structural members to walls in building construction is a process that is undertaken with grave attention and concern due to the significance of this attachment.

Under typical circumstances the structural members and walls experience gravity loading and compression distributed through the construction to the foundation or ground. However, the connection between the structural members and the walls may also experience loading in directions other than that caused by gravity. Specifically, these connections may experience loading caused by extreme wind, hurricane, earthquake, tornado, seismic conditions or the like. It is critical that the attachment of the structural members to the walls is designed to withstand the loading that these adverse conditions may subject the structure to. It is common that regulations or building codes require the structure to withstand vertical uplift loading within specified limits. These requirements may differ depending upon the geographic locations of the desired construction and the conditions that are typical for that area.

The prior art has established designs sufficient for undertaking the loading experienced by the attachments of structural members to walls and meeting the requirements set forth in the codes, specifications or regulations. The system typically employed for masonry walls includes a plurality of steel reinforcing bars throughout the wall and a plurality of anchors for fastening the structural members thereto. Typically, horizontal steel bars are set in the base or foundation and horizontal reinforcing bars are set in an upper concrete lintel poured in an upper region of the masonry wall. These foundation and lintel horizontal reinforcing bars are connected by a plurality of vertical reinforcing bars set within concrete poured columns within the masonry wall. The anchors are typically placed and set in the concrete lintel and include a hook or a similar configuration for interconnecting the anchor to the upper horizontal reinforcing bar. The structural members typically rest atop the wall and are secured to the anchors. The anchors typically include a plurality of apertures for receiving fasteners therethrough for securing the structural member to the anchor and consequently the masonry wall.

Although the system is sufficient for withstanding the applicable loading, there are drawbacks to the construction of this anchoring system. Firstly, the location of all anchors must be predetermined prior to the pouring of the concrete. All of the anchors must be accurately located in the construction of the masonry wall such that the structural members are accurately positioned in the construction of the carpentry. This requirement provides little flexibility to the design of the carpentry and requires that this design be completed beforehand. The placement of the anchors requires involvement of the carpenter with the mason during the phase of construction of the masonry wall. Consequently, all anchor locations must be measured and placed at the proper locations during the pouring of the concrete. Once the anchors are set, any design changes to the construction of the building would require an extreme amount of labor to incorporate.

Although the materials and components involved in this anchoring system are simple and low cost, the consequences of error are labor intensive and costly. If any error is made on the part of the draftsman, the mason or the carpenter and an anchor is cast in a wrong location, an alternate anchor must be selected, purchased, delivered, installed and inspected.

The prior art has overcome these disadvantages by providing adjustable anchoring systems that are embedded within concrete for either attaching structural members to a masonry wall or hanging pipes or conduit from a ceiling. Although these systems provide adjustment, the range of adjustment is limited in providing flexibility in the measurement and placement of the anchorage systems. Further, these adjustable anchoring systems comprise many components that are machined and/or welded, and are costly in light of the limited adjustability they provide.

The prior art provides various attachments for securing structural members to stud walls. These attachments comprise complex bracketry including designs for various applications. This bracketry typically requires fasteners installed in both the structural member and the stud wall. Accordingly, a builder attaching structural members to stud walls must retain a wide assortment of bracketry for the various attachment and securing possibilities encountered in the construction of a building.

Various techniques and designs have provided anchoring systems for attaching structural members to walls. It is the goal of the present invention to provide a simplified low cost, adjustable anchor system for securing structural members to walls.

SUMMARY OF THE INVENTION

The anchor system of the present invention attaches a series of structural members to a wall. The anchor system comprises an elongate horizontal track and a plurality of anchor plates. The track has a pair of spaced apart sidewalls defining therebetween an upwardly facing channel with a restricted opening. The anchor plates each have an enlarged head portion sized to fit within the channel and engage the sidewalls to retain the anchor plates at selected longitudinal positions. The anchor plate further includes a nailing plate and a relatively narrow strap extending between the head portion and the nailing plate. The strap is sized to pass between the side walls to position the nailing plate normal to the track for attaching the structural member thereto.

DETAILED DESCRIPTION OF THE PREFERRED EMBODIMENT(S)

Figure 1:
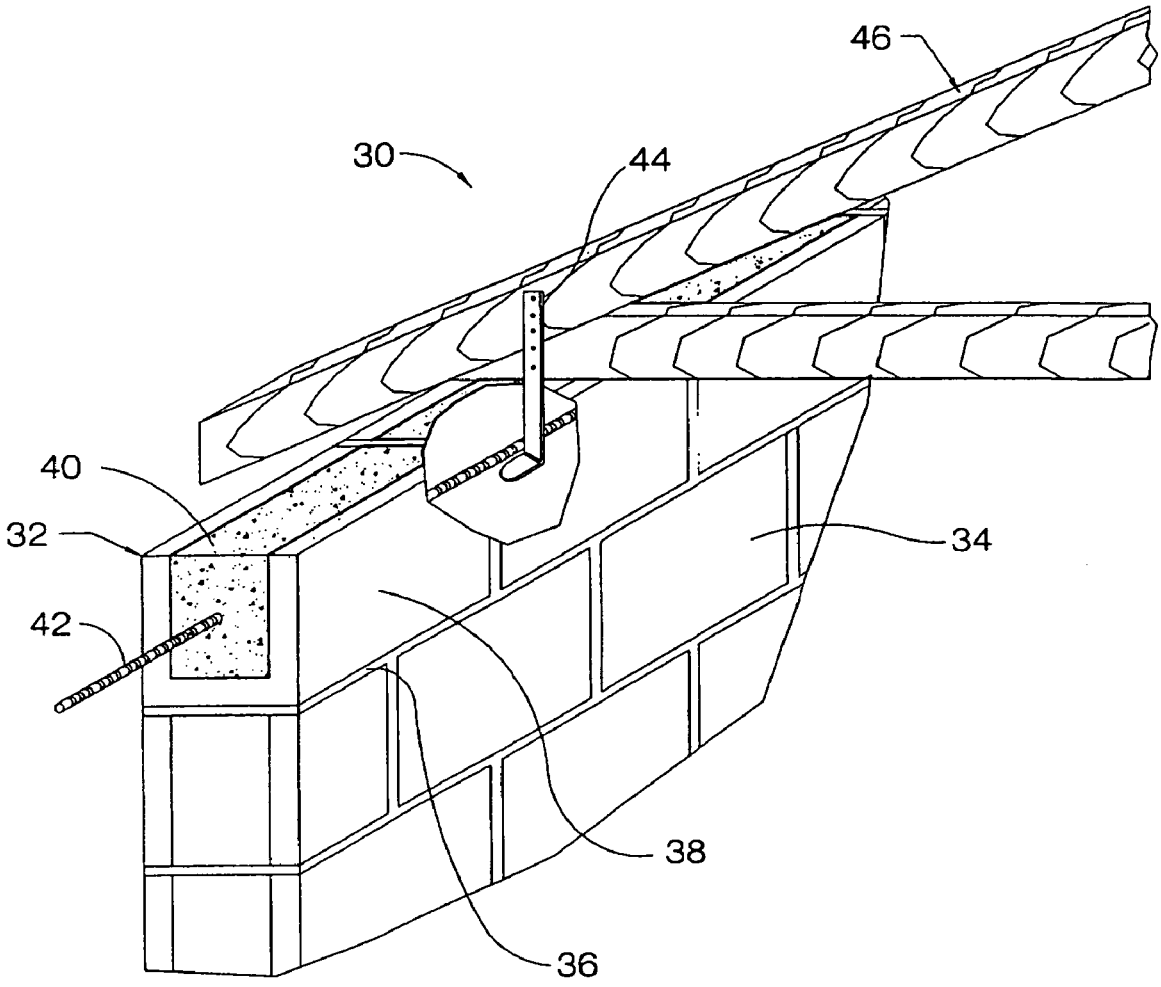
FIG.1 (Prior Art)
FIG. 1 is a partially broken perspective view of a prior art anchor system for attaching structural members to a masonry wall.

FIG. 1 is a perspective view of a prior art anchor system 30 incorporated herein to illustrate cooperation with a conventional masonry wall 32. The masonry wall 32 is substantially comprised of a plurality of masonry blocks formed of cinder aggregate or the like. The majority of the masonry blocks are full blocks 34 stacked atop each other, abutted end to end, and secured together with mortar 36. Full blocks 34 are typically hollow, each having two hollow openings (not shown) passing vertically therethrough. The full blocks 34 are typically staggered such that each individual full block 34 abuts two other full blocks 34, is stacked atop and secured to two immediately lower full blocks, and is stacked upon and secured to by two immediately upper full blocks 34.

The uppermost row of masonry blocks are lintel blocks 38 stacked atop the full blocks 34. The row of lintel blocks 38 is secured to the full blocks 34 and to each other by mortar 36. The lintel blocks 38 are also hollow having a U-shaped cross-section and upright openings.

Typically, vertical reinforcing bars (not shown) are disposed within the masonry wall 32 on eight to ten foot centers. The vertical reinforcing bars are disposed within aligned vertical openings through the full blocks 34. The lowermost end of each vertical reinforcing bar is located proximate to or interconnecting with an elongate reinforcing bar embedded within the concrete foundation or base. The uppermost end of each vertical reinforcing bar passes through a hole formed in the bottom of the lintel block 38 aligned with the vertical reinforcing bar. For this purpose, a separate lintel block 38 is provided having a preformed hole to be aligned with the vertical reinforcing bar. Concrete 40 is then poured through this vertical column for reinforcing the masonry wall 32 structure, and anchoring the vertical reinforcing bar therein.

Subsequently, concrete 40 is poured within the channel of the row of lintel blocks 38. A horizontal reinforcing bar 42 is disposed therein, typically embedded halfway within the overall height of the lintel blocks 38. After the concrete 40 is poured, a plurality of anchor straps 44 are inserted into the wet concrete having a lower end proximate to or interconnecting with the horizontal reinforcing bar 42. The anchor straps 44 are set in the concrete at predetermined locations such that structural members, referenced generally by numeral 46, are fastened or secured to the anchor straps 44.

The prior art anchor system 30 effectively ties the structural members 46 to the foundation. The overall structure of the masonry wall 32 distributes the gravity loading caused by the overall weight of the structure in a downward direction to the base and foundation. The concrete 40 of the masonry blocks sufficiently support the compression applied thereupon. Although the concrete can support high compressive loads, concrete is a weak medium for handling tensile loads. Accordingly, the horizontal and vertical reinforcing bars reinforce the concrete structure when the structure experiences tension.

During inclement weather conditions, uplift pressure applied to the structural members is translated through uplift forces on the anchor straps 44 to the horizontal reinforcing bar 42. These uplift forces applied to the horizontal reinforcing bars 42 are distributed through the vertical reinforcing bars to the horizontal foundation reinforcing bars. Therefore, the uplift forces applied to the structure are counteracted by the overall weight of the structure.

The uplift forces applied to the reinforcing bar 42 and the resultant forces experienced within the concrete 40 and the horizontal reinforcing bar in connection with the vertical reinforcing bars causes the horizontal reinforcing bar 42 to experience longitudinal tension. Consequently, the uplift forces applied to the vertical reinforcing bars counteracted by the gravity of the structure causes the vertical reinforcing bars to experience tension. Finally, uplift forces applied to the horizontal reinforcing bars in the foundation at the connections with the vertical reinforcing bars are counteracted by the weight of the structure causing the horizontal foundation reinforcing bars to experience longitudinal tension having peaks at the locations of the vertical reinforcing bars.

In summary, the prior art anchor system 30 overcomes the loading problems caused by strong winds, hurricanes, earthquakes, tornadoes, seismic loading conditions or the like. However, prior art anchor system 30 provides no room for error amongst the phases of design, masonry and carpentry. Further, the prior art anchor system 30 requires much interaction between these three phases of construction to ensure that all anchor straps 44 are properly located. Further, there is no flexibility in the prior art anchor system 30 to allow changes in design once the anchor straps 44 are set. Any change in the design or correction of error results in high labor costs generated in the selection, purchase, delivery, installation and inspection of an alternate anchor.

Figure 2:
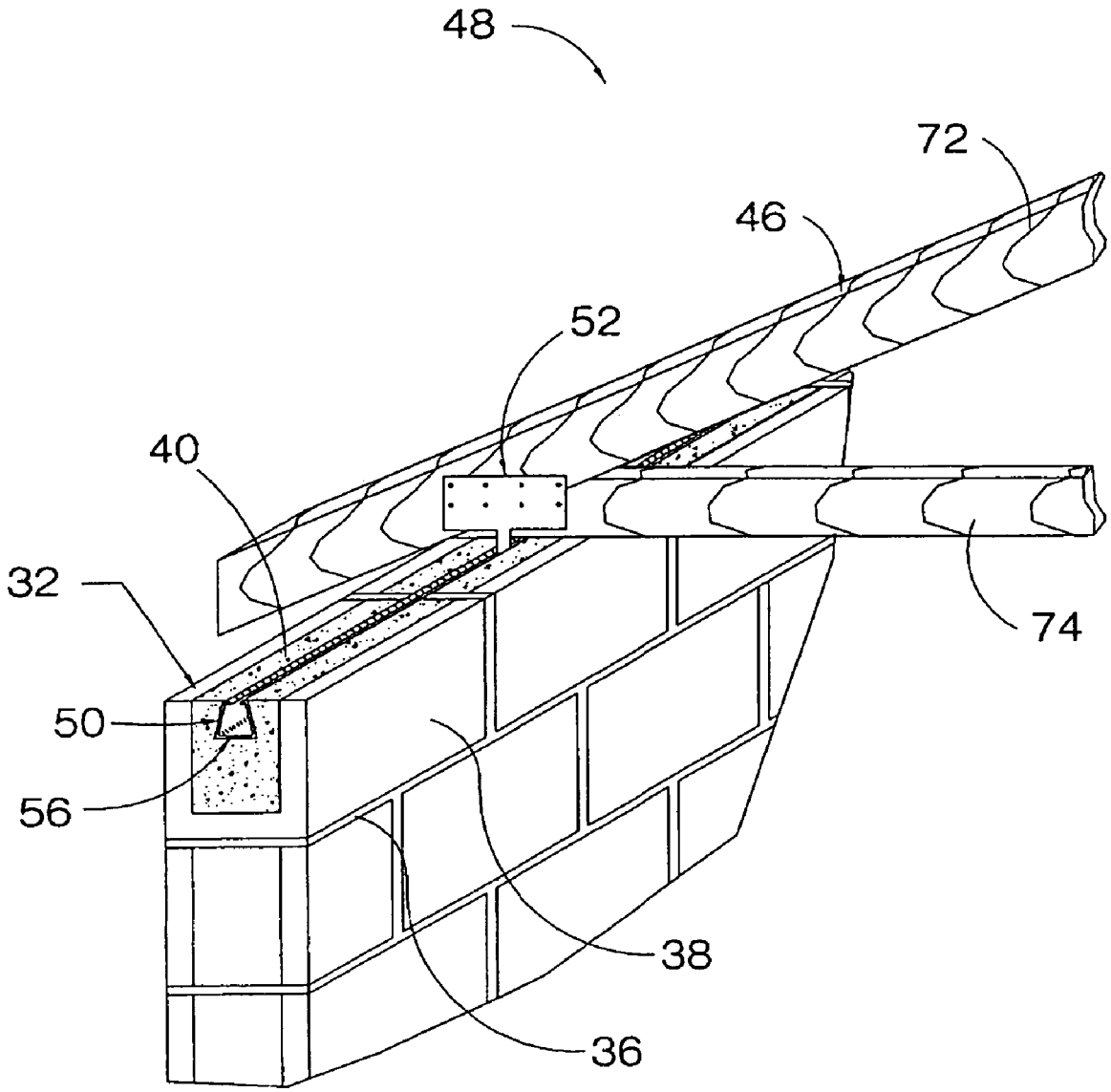
FIG. 2 is a perspective view of an exemplary embodiment anchor system of the present invention.
Figure 3:
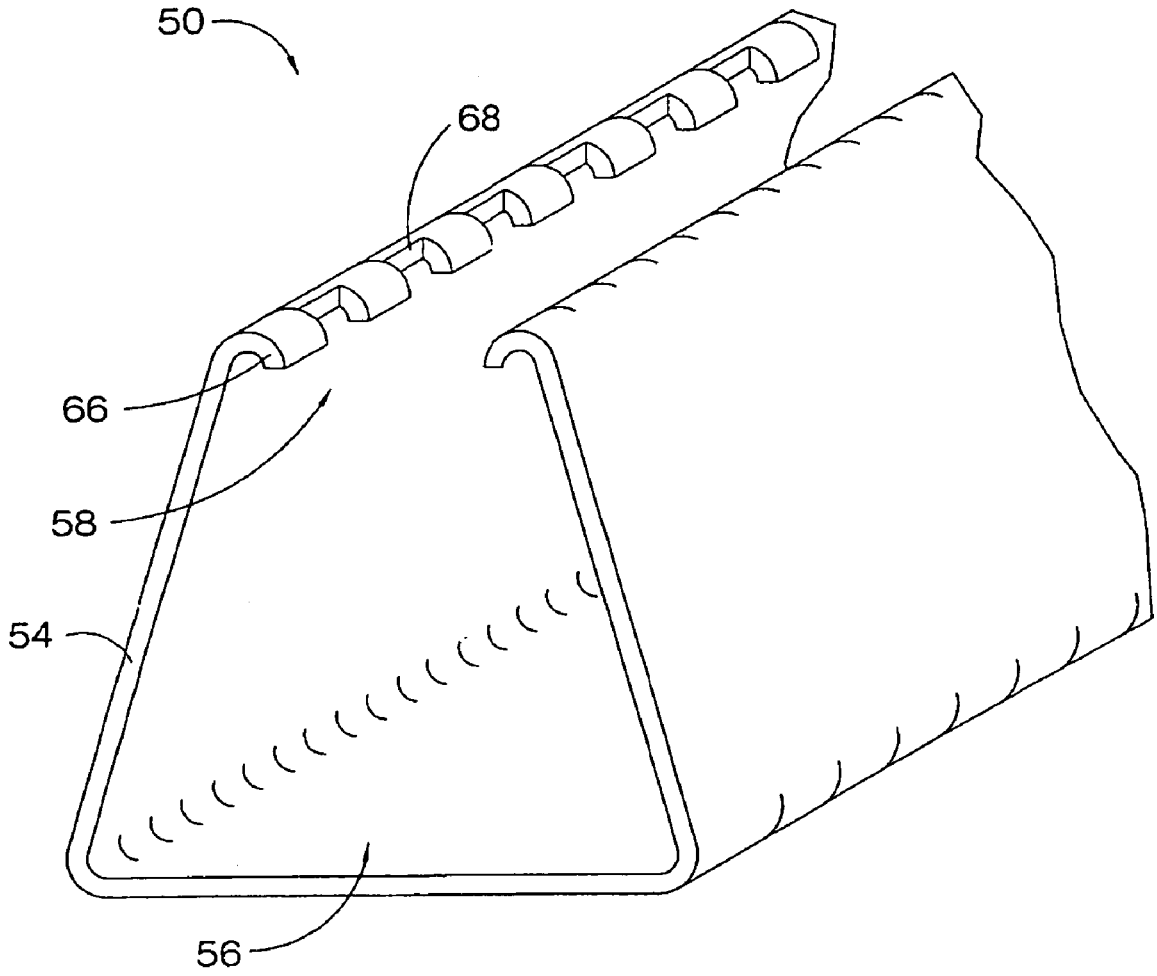
FIG. 3 is a perspective view of an exemplary track of the anchor system of FIG. 2.
Figure 4:
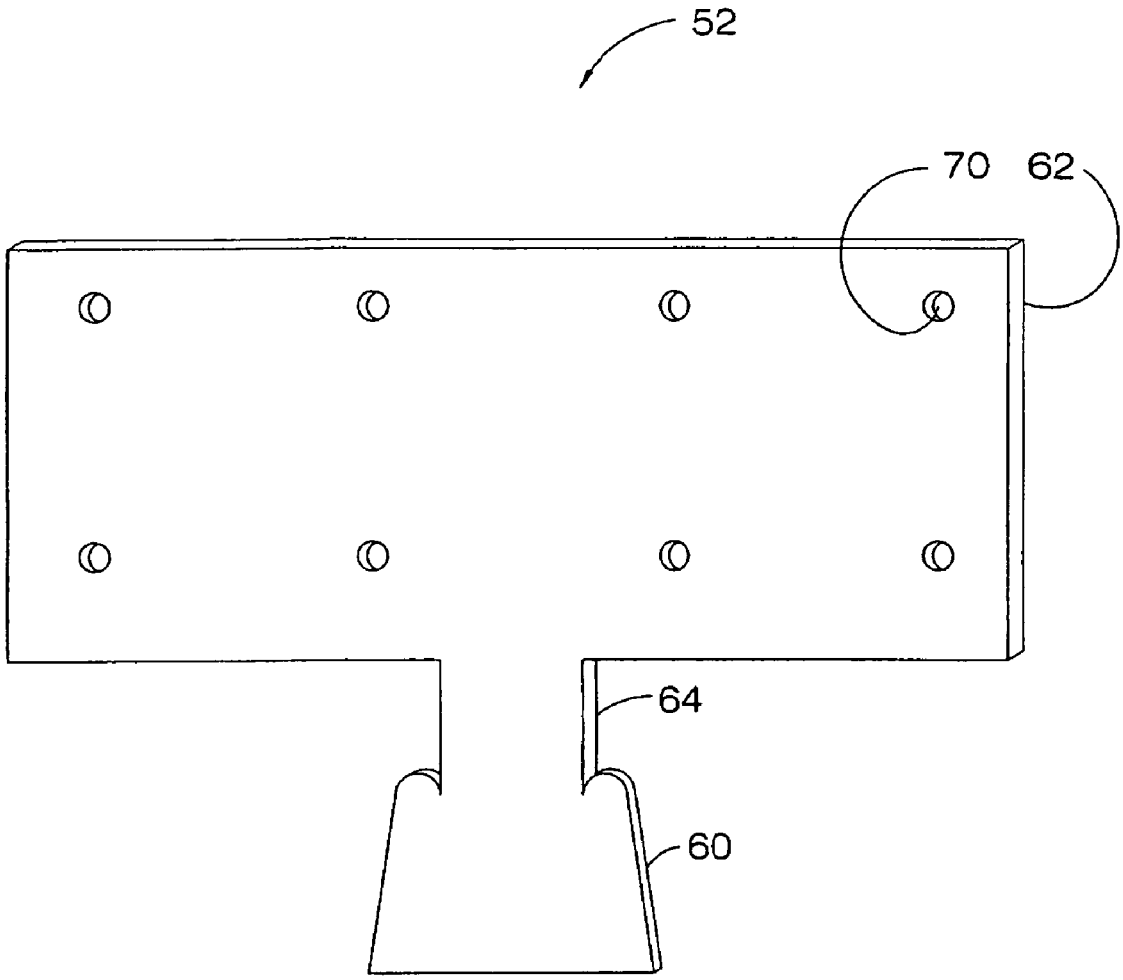
FIG. 4 is a perspective view of an exemplary anchor plate of the anchor system of FIG. 2.

Referring now to FIGS. 2-4, an exemplary embodiment anchor system 48 is illustrated and described in detail. Similar elements retain the same reference numerals and new elements are assigned new reference numerals. The anchor system 48 comprises an elongate track 50 and a plurality of anchor plates 52 for attaching a series of structural members 46 to a masonry wall 32. It is apparent that where masonry filled with concrete is shown defining the masonry wall 32, the masonry can be omitted and an all concrete wall may be used within the scope of the invention.

The track 50, as illustrated in FIG. 3, includes a pair of spaced apart sidewalls 54 defining therebetween an upwardly facing channel 56 with a restricted opening 58. Each anchor plate 52, best shown in FIG. 4, has an enlarged head portion 60, a nailing plate 62 and a relatively narrow strap 64 extending between the head portion 60 and the nailing plate 62. The head portion 60 is sized to fit within the channel 56 and engage the sidewalls 54 to retain the anchor plate 52 at a selected longitudinal position with respect to the track 50. The strap 64 is sized to pass between the sidewalls 54 through the opening 58 in the track 50 to position the nailing plate 62 normal to the track 50.

The head portion 60 of the anchor plate 52 has a width greater than the width of the opening 58 in the track 50. The thickness of the anchor plate 52 is less than the opening 58 such that the head portion 60 of the anchor plate 52 may be inserted into the opening 58 of the track 50 at a first orientation, generally parallel with the length of the track 50. The anchor plate 52 is then rotated to a second orientation such that the nailing plate 62 is normal to the track 50. In this manner, the head portion 60 of the anchor plate is retained within the channel 56 of the track due to the interference of the head portion 60 provided by the sidewalls 54. This cooperation between the anchor plate 52 and the track 50 allows a user to insert an anchor plate 52 into the track 50 and slide the anchor plate 52 to a selected longitudinal position. When the anchor plate 52 is located at a position against a structural member 46, the user lifts the anchor plate 52 such that the head portion 60 engages the sidewalls 54 and fastens the anchor plate 52 to the structural member. This engagement secures the structural member 46 to the selected longitudinal position with respect to the track 50. The anchor plate 52 is fastened to the structural member 46 by fasteners inserted through the nailing plate 62. The cooperation of anchor plate 52 and structural member 46 retains the anchor plate 52 in the raised position, engaged with the track 50. Concomitantly, the cooperation secures the structural member 46 in the selected longitudinal position with respect to the track 50.

As shown in FIG. 2, the track 50 is embedded within the concrete 40 and generally spans the length of the masonry wall 32. After the concrete 40 is poured into the lintel blocks 38, the mason simply places an elongate track 50 within the concrete generally centered within the lintel blocks 38 such that the opening 58 faces upward and out of the concrete 40. It may be conceived that flotation problems may occur from the tracks 50 inserted within the freshly poured concrete 40. Accordingly, it may be advantageous to prevent the tracks 50 from floating or uplifting within the wet concrete 40 by placing a series of bricks periodically along the length of the track 50.

This process has many advantages over the prior art. Firstly, the anchor system 48 of the present invention provides a separation of trades between the mason and the carpenter. The mason may simply construct the masonry wall 32 and place tracks 50 within their upper regions without having to work with the carpenter for measuring and placing a plurality of anchor straps 44 within the concrete 40. Thus, the construction may be easily separated into two phases of masonry and carpentry without much interaction of the two.

Furthermore, the adjustability of the anchor system 48 allows the carpenter to simply measure and secure the locations of the structural members 46 with respect to the masonry wall 32. If any changes are made to the design of the carpentry, or if any errors are made in the design of the carpentry or the locating of the structural members 46, the structural members 46 may be easily relocated without having to retrofit the anchor system 48.

The track 50 and the anchor plate 52 are formed of sheet steel or the like. Sheet steel is strong enough to withstand the required loads without necessitating an extreme thickness of the material.

Track 50 is manufactured using cold-formed processes. Processes such as rolling and bending are employed to effectively create the elongate track 50 having a generally U-shaped cross-section defined by the channel 56 and opposed sidewalls 54. The track 50 may be reinforced against uplift loads by forming a lip 66 displaced along an upward region of each sidewall 54 preferably facing inward towards the channel 56. The lip 66 enhances the engagement of the track 50 and the head portion 60 of the anchor plate 52 thus increasing the pull out strength or capacity of the attachment of the structural member 46.

Further, a series of incrementally spaced recesses 68 may be formed along the downwardly extending lips 66. The recesses 68 are sized to receive a thickness of the head portion 60 such that the anchor plates 52 are securely attached to the sidewalls 54. This feature allows a user to slide the anchor plate 52 to the desired longitudinal position and then lift the anchor plate such that the head portion 60 engages the recesses. Accordingly, the recesses 68 are formed incrementally, for example, every ¼", allowing the user to locate the structural members 46 at a nominal location. Furthermore, if a user needed to adjust the positioning of the structural member 46 by a selected distance, the user may simply use the incrementally spaced recesses 68 to measure this distance rather than having to measure the distance with a separate measuring tool. The recesses 68 may be formed in the track by a material removal process, however it is preferred that the recesses are pressed within the lip 66 thus maintaining or even enhancing the strength of the lip 66. Although the invention incorporates a series of recesses, the invention contemplates a series of protuberances formed along the sidewalls 54 for achieving similar benefits provided by the recesses 68.

The anchor plates 52 are also manufactured by cold-forming processes to create a component sufficient to withstand the described loads while maintaining attachment of the structural members 46. The invention contemplates that the anchor plates 52 comprise any geometry adequate for cooperating with the track 50 and attaching to the structural members 46. Specifically, the nailing plate 62 can take the form of any polygonal shape corresponding to the size and shape of the structural member 46 attached thereto. Preferably, the nailing plate 52 includes a plurality of apertures 70 sized to receive fasteners such as wood screws, sheet metal screws, machine screws, nails or the like for fastening the anchor plate 52 to the structural members 46.

As shown in FIG. 2, the anchor plate 52 is adapted to secure the structural member 46 illustrated as a truss for supporting a structure, such as a roof and comprising of a top truss chord 72 and a bottom truss chord 74. Further, the invention contemplates that the structural member 46 may be any structural member used in building construction and attached to a wall. Furthermore, the structural member 46 may be a rafter for supporting a pitched roof or a rafter for supporting a pitched ceiling and a pitched roof having a steeper pitch than that of the ceiling. Even further, the structural member may be defined as any horizontal beam used for support in construction including but not limited to joists set parallel from wall to wall to support a floor or ceiling, or girders for providing building support across walls. The invention even contemplates that the structural member be a diaphragm or any thin plate or partition between parallel parts of structural members for enhancing rigidity. Further yet, the invention contemplates that the structural member may be a stud, scantling, lath or any upright member used in construction for supporting a structure, wall, ceiling, or floor or supporting any aesthetic or functional application including plaster, shingles, slates, tiles, furring, wallboard, or similar material.

A structural member 46 may be anchored to the masonry wall 32 by one anchor plate 52 mounted on one side or a pair of anchor plates 52 mounted on opposite sides. The number of anchor plates 52 required is specified by the application and subject to the load requirements. When two or more structural members 46 are attached to the masonry wall 32 adjacent one another, the first structural member 46 is secured by a pair of anchor plates 52 fastened to either side thereof, and the second structural member is secured adjacent to one of the anchor plates 52 by a single anchor plate 52 mounted on the outboard side thereof. The outboard anchor plate 52 sandwiches the second structural member against one of the anchor plates 52 fastened to the first structural member 46.

The track 50 spans the length of the masonry wall 32 and has an overall length substantially equivalent to the overall length of the wall 32, such that the track defines a horizontal reinforcing member of the wall. In comparison to the prior art, the track 50 replaces the horizontal reinforcing bar 42. In summary, the present invention anchor system 48 distributes the load from the structural members 46 to the anchor plates 52 to the track 50. The load is distributed from the track 50 to the vertical reinforcing bars through their connection within the concrete 40. Subsequently, the vertical reinforcing bars distribute the load to the foundation reinforcing bars. Therefore, the cooperation of the track 50 and the concrete 40 and the interrelationship of the track 50, concrete 40 and vertical reinforcing bars is critical to determine the pullout capacity of the anchor system 48.

When uplift forces are applied to the track 50 at its connections with the structural members 46, and corresponding reaction forces are developed at the locations of the vertical reinforcing bars, the track 50 undergoes tension along its length. Accordingly, the elongate frictional adhesion of the outer peripheral surfaces of the track 50 embedded within the concrete 40 enhances the anchor system. The track 50 has a large peripheral surface area in comparison to the horizontal reinforcing bar 42 of the prior art anchor system 30 thus improving the adhesion.

Due to the pullout load applied at the attachment locations, the securing of the track 50 within the concrete 40 is critical to ensure the track 50 does not pull out of the concrete 40. Accordingly, it is preferred that the track 50 has a cross-section profiled to anchor the track 50 within the concrete 40. This anchoring is accomplished in a combination of the surface area of the periphery of the track 50 and a mechanical interlock between the cooperation of the track 50 and the concrete 40. The mechanical interlock can be achieved by providing sidewalls that are tapered such that the opening 58 is narrow with respect to a lower region of the channel 56 for anchoring the track 50 securely. The tapered sidewalls 54 allow concrete 40 to collect in a region above a portion of the track 50 such that the securing of the track 50 further includes pressure applied upon the surface by concrete 40 residing generally thereabove. Further, the pressure applied to the tapered sidewalls 54 resists against deformation of the track 50 from uplift forces applied to the anchor plates 52.

Figure 5:
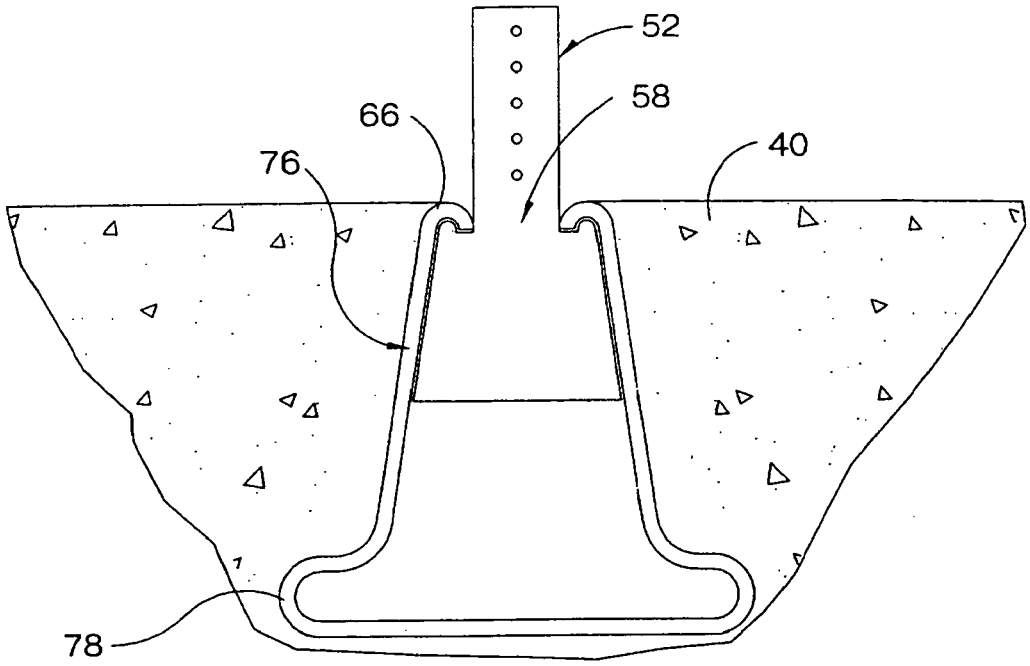
FIG. 5 is a side elevation section view of another exemplary embodiment anchor system.

Referring now to FIG. 5, an exemplary track 76 in accordance with the present invention is illustrated. Once again, similar elements retain same reference numerals, wherein new elements are assigned new reference numerals. The track 76 is similar to the previously illustrated and described track 50, however further comprising a pair of lateral flanges 78, each displaced along opposing sidewalls 54 for improving the anchoring of the track 76 within the concrete 40. Cracks in concrete, caused by uplift forces, typically propagate at forty-five degrees, thus the pullout capacity is directly related to the width of the pair of lateral flanges 78. Accordingly, the larger the width, the more concrete 40 will reside above the track 76 and consequently the greater the pullout capacity will be of the anchor system 48. Therefore, an ideal profile for the track 76 is a direct result of a balance between the pullout capacity sufficient for the application and the cost of materials and manufacturing required to produce the track 76. Accordingly, the tradeoffs between materials and strength must be considered in determining the proper geometry of the track 76. The invention contemplates that various profiles may be produced for providing a variety of tracks having varying prices and pullout capacities.

Figure 6:
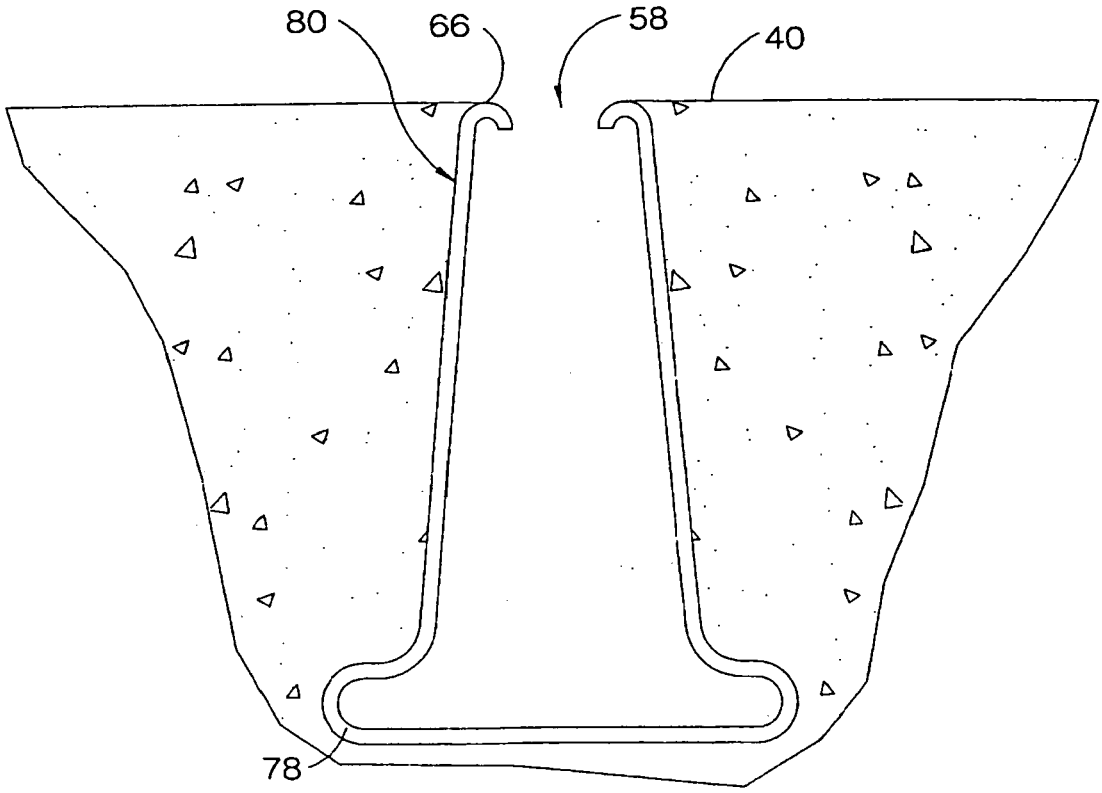
FIG. 6 is a side elevation section view of another exemplary track.

Referring now to FIG. 6, an exemplary track 80 is illustrated in accordance with the present invention. Likewise, the pullout capacity of the track 80 is enhanced by providing a pair of lateral flanges 78 displaced further from the opening 58 such that a substantially greater amount of concrete is retained in a region above the flanges 78 wherein cracks in the concrete 40 would propagate.

Figure 7:
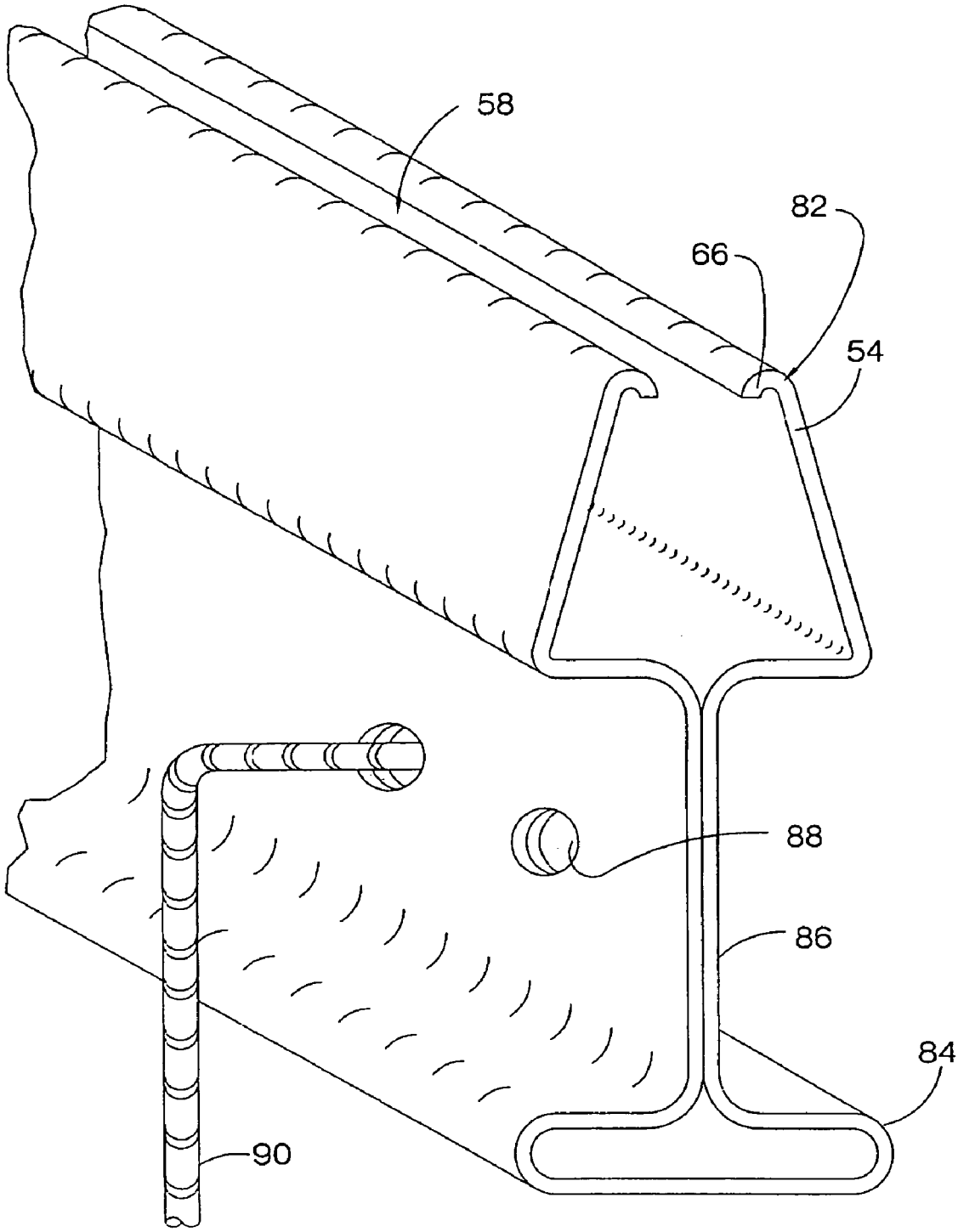
FIG. 7 is a perspective view of yet another exemplary track illustrated in cooperation with a vertical reinforcing bar.

Another exemplary track 82 in accordance with the present invention is illustrated in FIG. 7. The track 82 has a cocktail glass cross-section including a flange 84 spaced apart from the sidewalls 54 by a longitudinal web 86 formed within the profile of the track 82. A large surface area is provided about the periphery of the track 82 and embedded within the concrete 40, thus enhancing adhesion of the track 82 therein. Further, the displacement of the flange 84, from the opening 58, within the concrete 40 further secures the track 82 from uplift forces due to the pressure applied by the concrete retained generally above the longitudinal flange 84. Preferably, the longitudinal web 86 extends midway through the overall height of the lintel block 38 such that the flange 84 is disposed at a depth normally achieved by a conventional horizontal reinforcing bar 42.

Conventional reinforcing bars typically include an exterior surface having a plurality of configurations for improving the adhesion within concrete. Accordingly, the longitudinal web 86 of the track 82 includes a series of apertures 88 sized to allow the concrete 40 to seep therethrough for mechanically interlocking the track 82 within the concrete 40.

To further enhance the interrelationship of the track 82, concrete 40 and vertical reinforcing bar, the track 82 is connectable to a vertical reinforcing bar (illustrated in FIG. 7 and referenced by numeral 90). This connection may be provided by the vertical reinforcing bar disposed within one of the corresponding apertures 88 in the track 82. Although this connection is not required due to the operable connection between the track 82 and the vertical reinforcing bar 90 through the concrete 40, it further enhances the overall pull-out capacity of the anchor system 48. Further, this connection may be difficult to achieve within the concrete 40. Although the track illustrated in FIG. 7 is more costly to manufacture in comparison to the other track embodiments, the pull-out capacity provided justifies these costs for loading under extreme conditions.

The sidewalls 54 are tapered to improve the anchoring of the track 82 within the concrete 40 by allowing concrete to collect in a region above the sidewalls. This enhances the engagement of the track 82 with the anchor plates 52, by providing pressure to the sidewalls 54 to prevent deformation of the sidewalls 54 due to pullout forces applied by the anchor plates 52.

Figure 8:
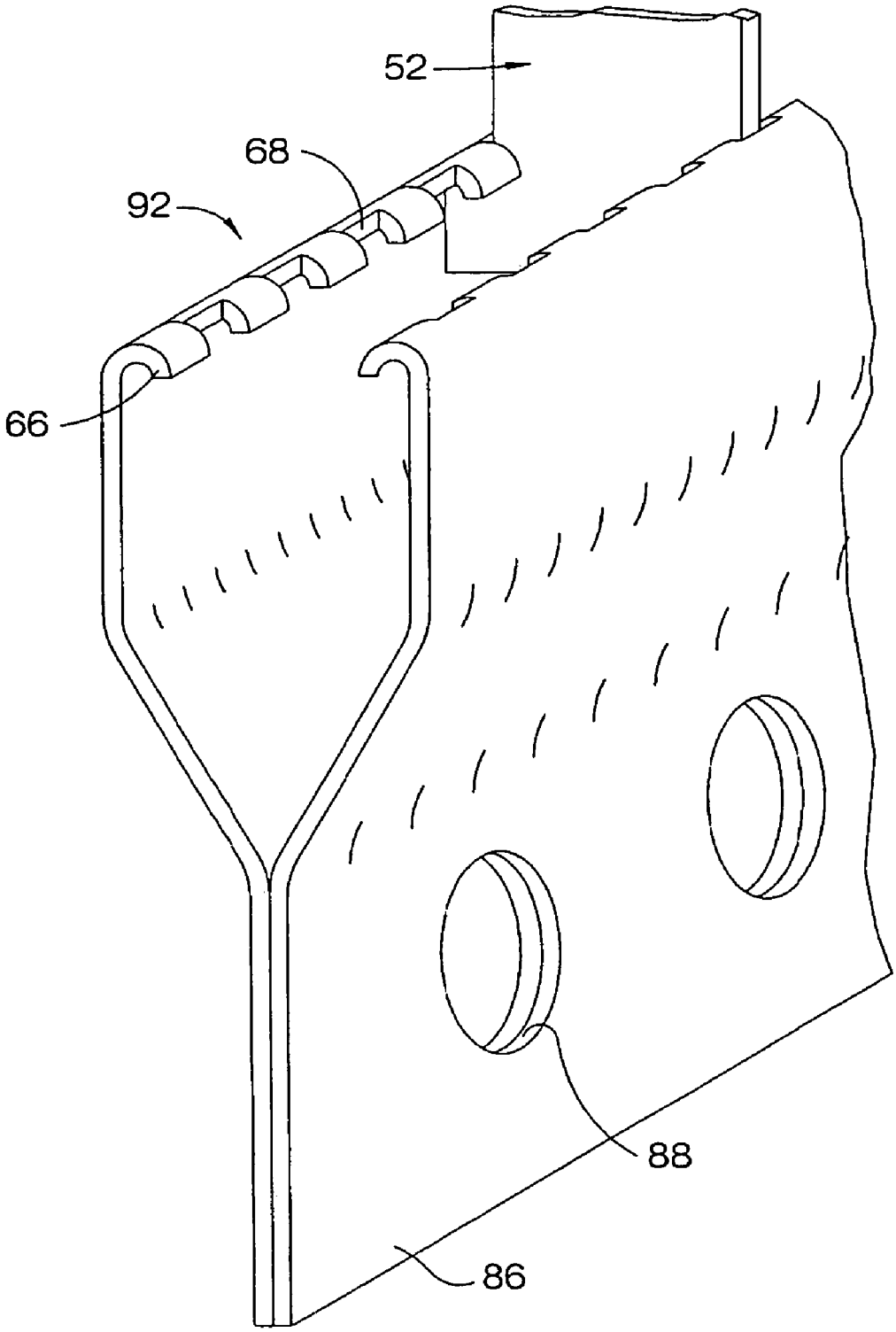
FIG. 8 is a perspective view of another exemplary embodiment anchor system.

Referring now to FIG. 8, yet another exemplary track 92 is illustrated, similar to the cocktail glass profiled track 82 illustrated in FIG. 7. The track 92 does not include a flange, and withstands the vertical uplift force by the mechanical interlock of the concrete 40 through the apertures 88 in the longitudinal web 86. The track 92 may be unitarily formed from a cold-forming manufacturing process or may be formed from a two-piece construction having symmetrical halves that are welded or pressed together. The trade-offs in the design of the track 92 are that less material is required, however, the resistance to uplift forces is decreased due to the absence of a flange 84.

Figure 9:
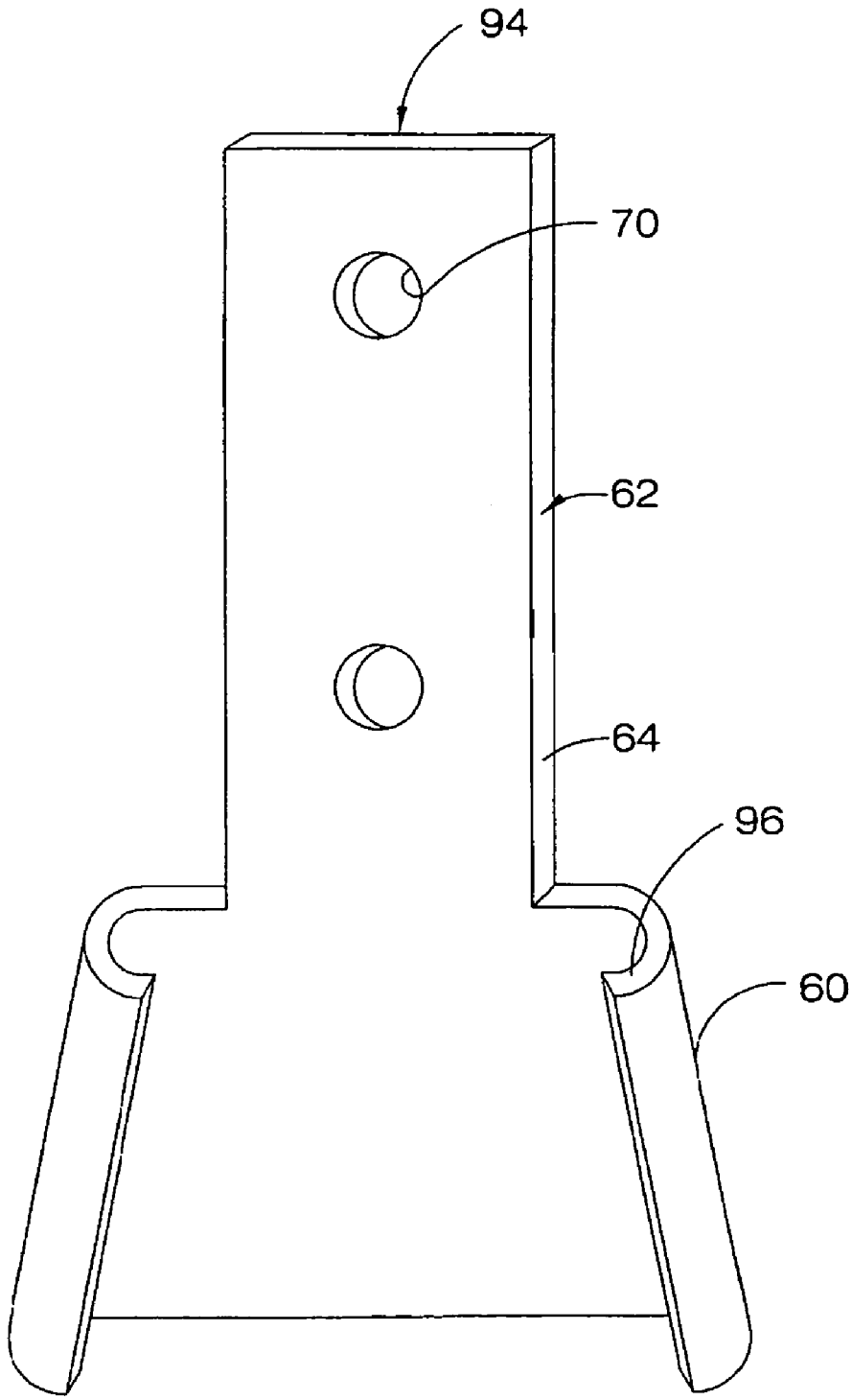
FIG. 9 is a perspective view of an exemplary anchor plate.

Referring now to FIG. 9, an exemplary anchor plate 94 is illustrated. The anchor plate 94 includes a pair of lips 96 formed along the head portion 60. The lips 96 may be formed in a cold-forming manufacturing process or the like. The lips 96 increase the thickness of the head portion to enhance the pullout capacity of the connection between the anchor plate 94 and the track 50. The lip 96 increases the thickness of the head portion 60 such that the engagement between the head portion 60 and the track 50 is substantially an area contact, rather than the generally line contact provided by the narrow thickness of the head portion 60. The recesses 68 formed within the track 50 may be sized to receive the total thickness of the head portion 60 and lip 96. Alternatively, a gap may be provided between the lip 96 and head portion 60 such that the head portion 60 engages one pair of recesses 68 in the track 50, and the pair of lips 94 engage another pair of recesses 68 in the track 50.

Figure 10:
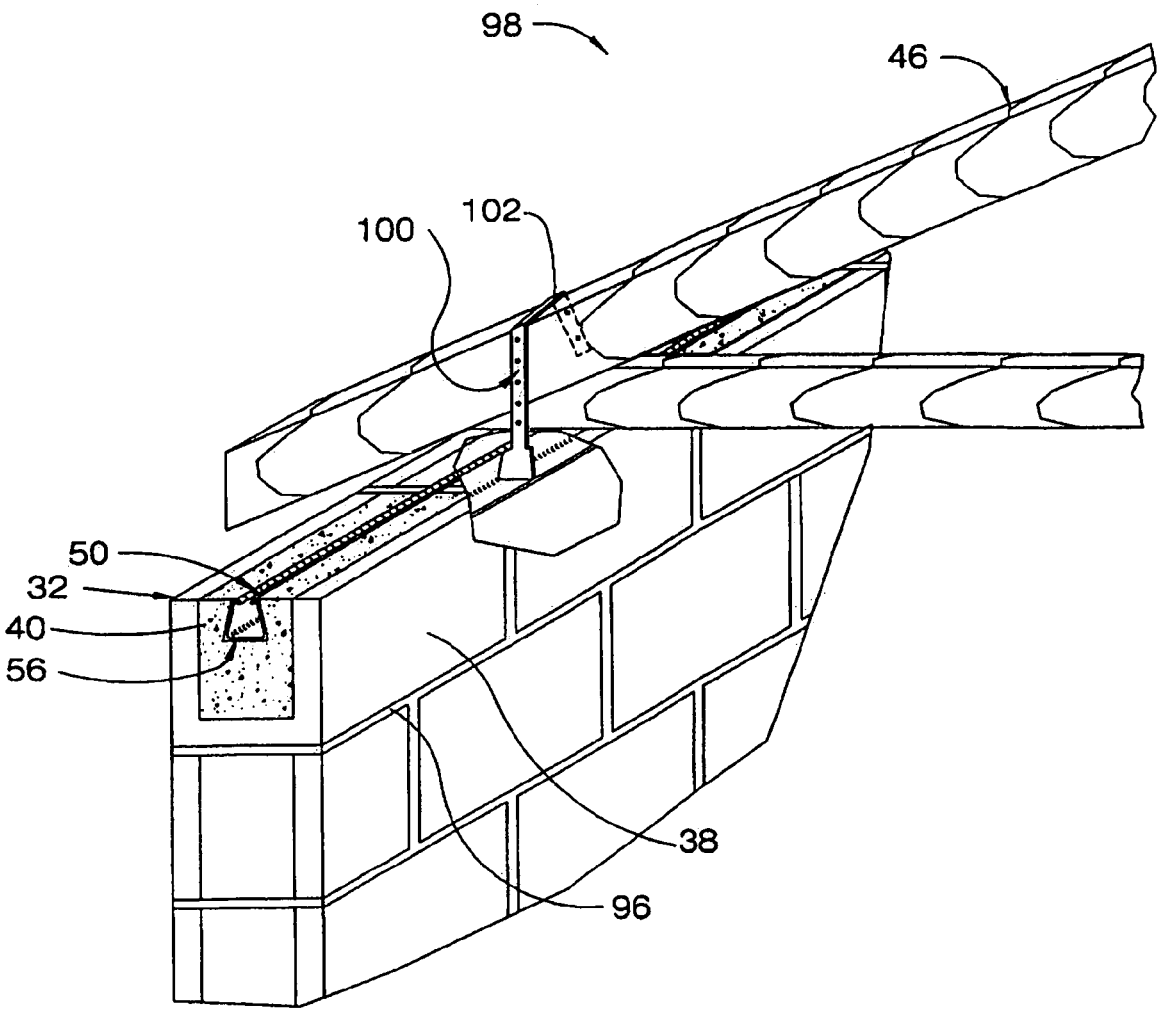
FIG. 10 is a perspective view of another exemplary embodiment anchor system illustrated attaching a structural member to a masonry wall.

Referring now to FIG. 10, an exemplary anchor system 98 is illustrated employing an exemplary anchor plate 100 in accordance with the present invention. The anchor plate 100 includes a plurality of bends 102 such that the anchor plate 100 contacts at least two planar surfaces of the structural member 46. In this manner, the structural members 46 may be more securely tied down to the masonry wall 32 having enhanced attachment to the anchor plates 100. Further, a pair of anchor plates 100 may be attached to structural members 46 on either side thereof for improving this attachment.

In comparison to the bracketry of the prior art, which provided a plurality of brackets having a nailing plate specific to the structural member of each application, and a nailing plate specific to the wall of each application, the present invention provides anchor plates that have nailing plates 62 specific to the structural members 46 and having a common head portion 60 such that a narrower assortment of anchor plates is required to meet a variety of structural member to wall attachment applications.

Figure 11:
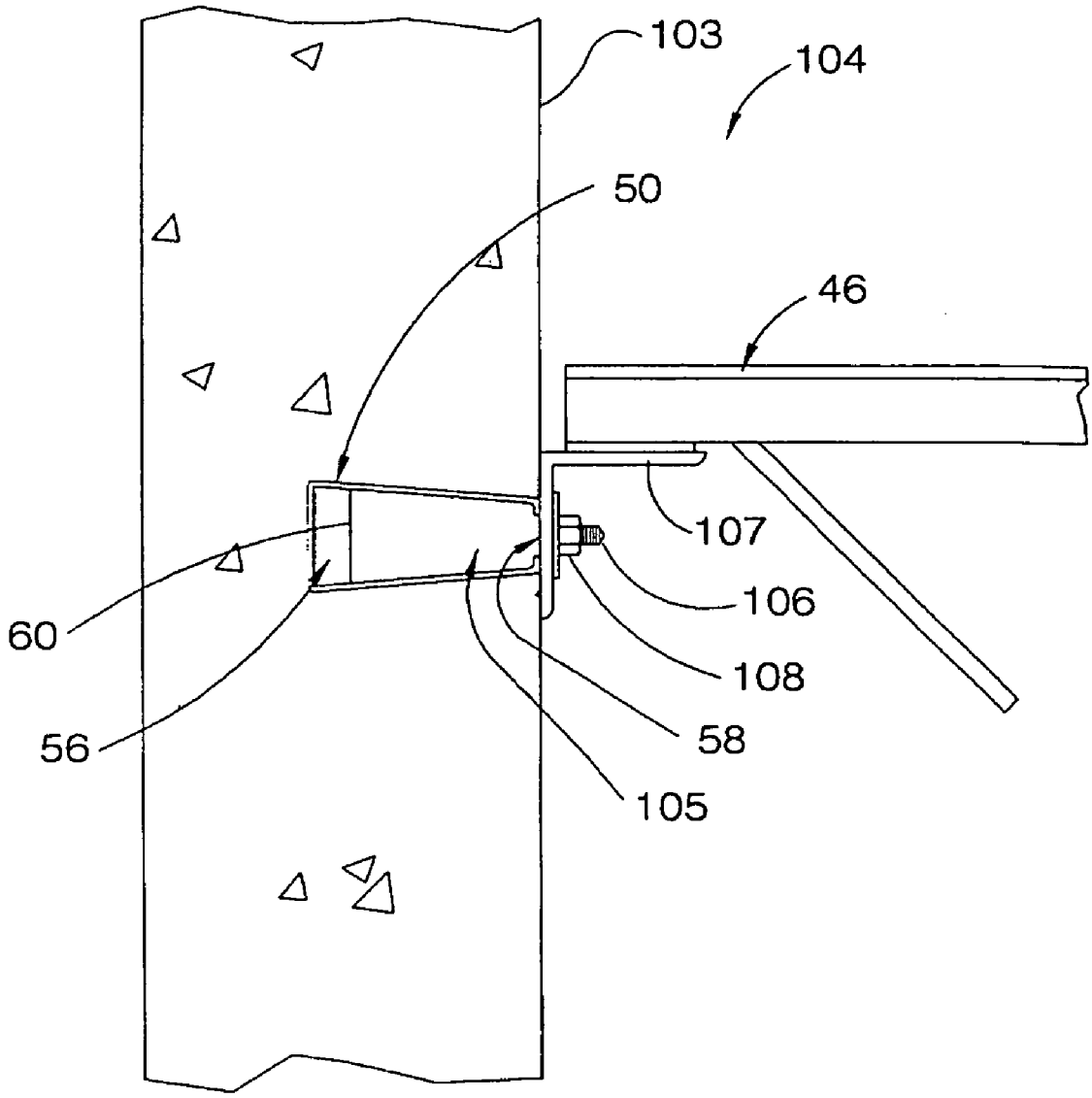
FIG. 11 is a side elevation section view of an exemplary embodiment anchor system illustrated attaching a structural member to a concrete wall.

The invention may also be used for attaching structural members 46 to the side of a concrete wall 103 as illustrated in an exemplary anchor system 104 in FIG. 11. The track 50 of anchor system 104 is oriented such that the opening 58 faces outwardly through the side of the concrete wall 103. The anchor system 104 further includes an anchor plate 105 having an enlarged head portion 60 disposed within the channel 56 of the track 50, and a threaded end 106 extending through the opening 58 in the track 50. A steel angle 107 is fastened to the anchor plate 105 by threaded nut 108. The steel angle 107 is continuous thereby providing a ledger for support of a structural member at any location along the angle 107. The invention contemplates that any ledger, for example wood, could be attached in a similar manner to that of the steel angle 107 for securing structural members 46 to the concrete wall 103.

Figure 12:
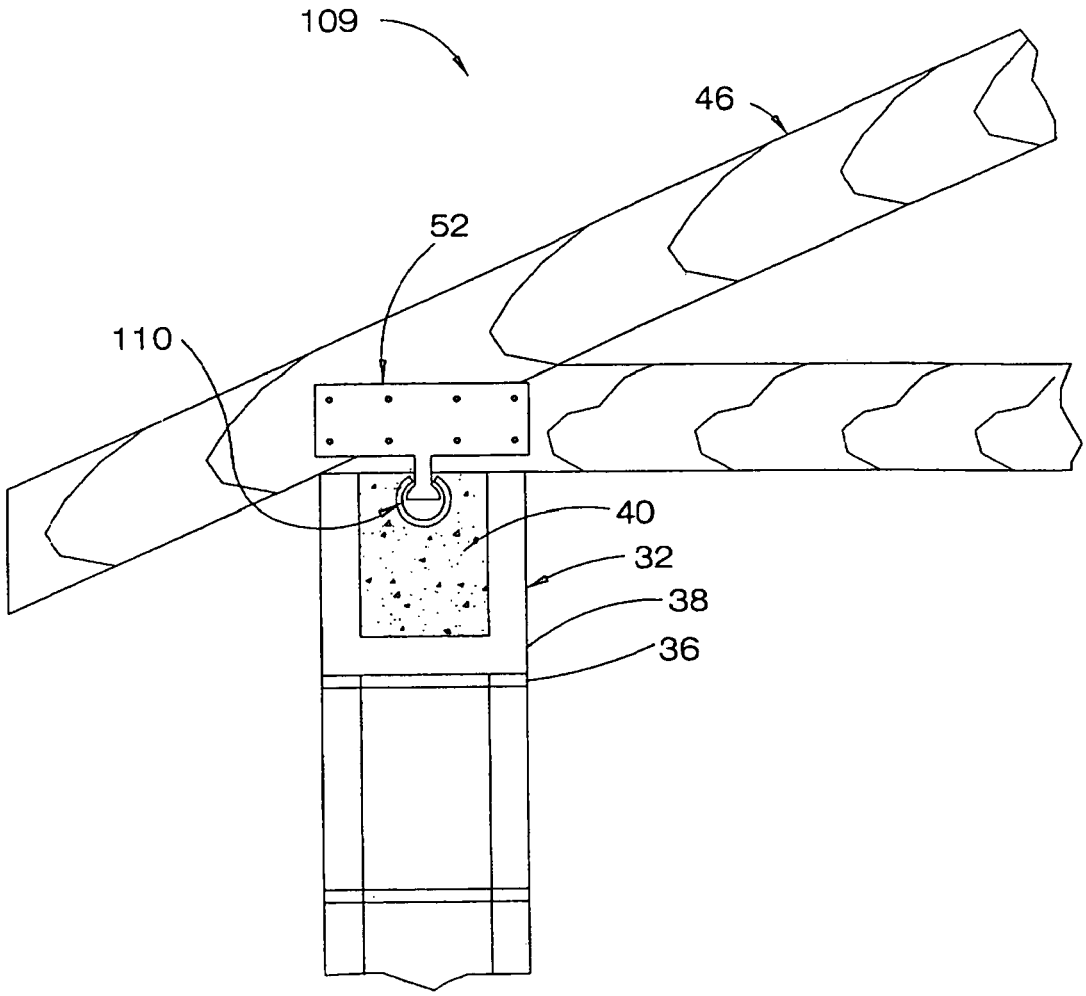
FIG. 12 is a side elevation section view of another exemplary embodiment anchor system attaching structural members to a masonry wall.

In FIG. 12, an exemplary anchor system 109 is illustrated comprising a simplified track 110 having a generally semi-circular cross-section. Although the track 110 is not as resistant to adverse loading in comparison to the prior disclosed tracks of the present invention, it has a simpler profile that requires less material to manufacture, and can be simply cold-formed by a rolling process. This track 110 is ideal as a low cost solution for securing structural members 46 to the masonry wall 32 in applications that are not susceptible to high uplift loads.

Figure 13:
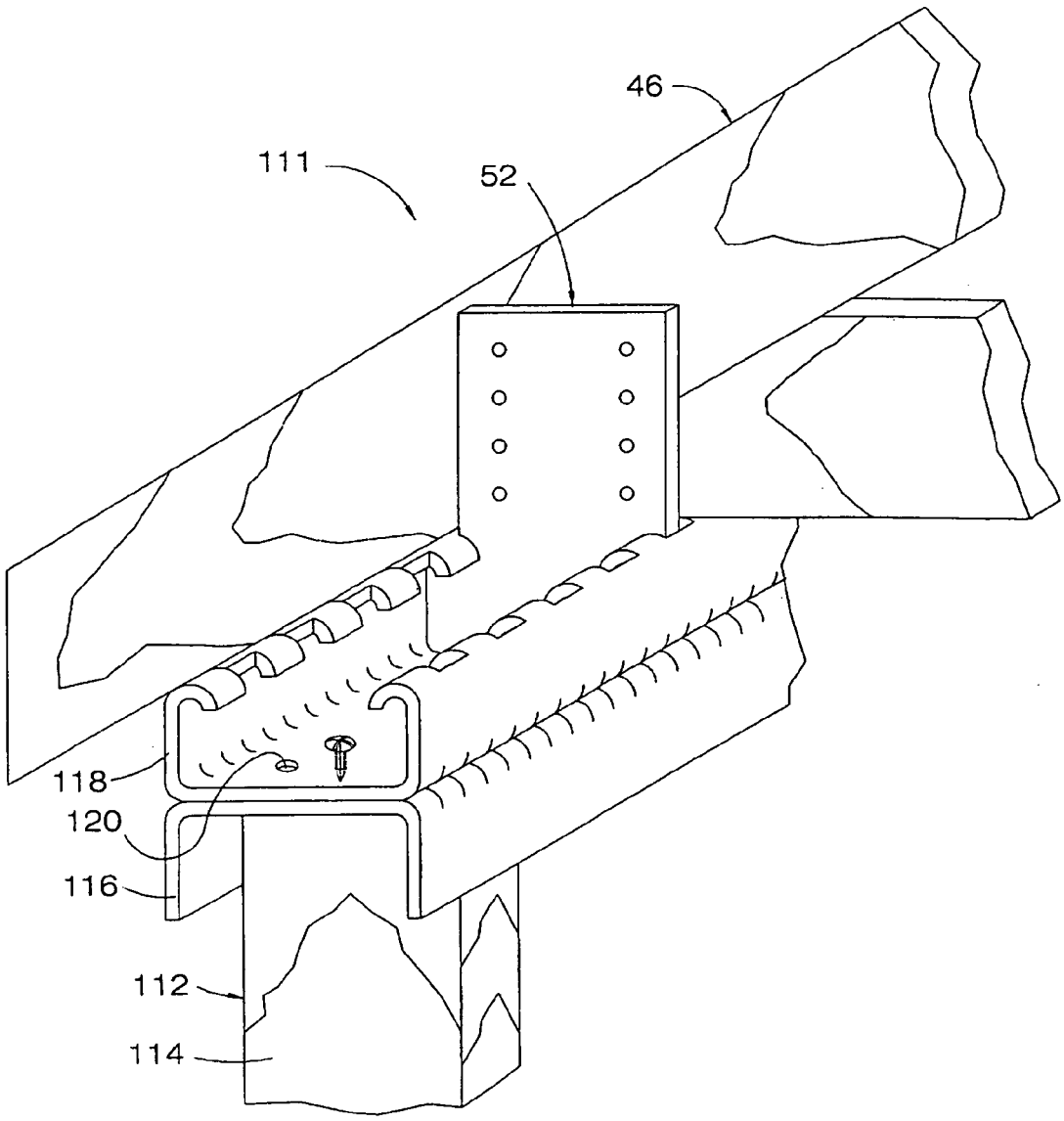
FIG. 13 is a perspective view of an alternative embodiment anchor system illustrated attaching structural members to a stud wall.

The invention contemplates that the anchor system may be used on walls other than masonry walls in the aforementioned anchor system embodiments. For example, as seen in FIG. 13, an alternative anchor system 111 in accordance with the present invention may be used for securing structural members 46 to a stud wall 112. Stud wall 112 comprises a series of upright studs 114 interconnected by a longitudinal head rail 116. The anchor system 111 requires a track 118 having a simplified profile including a generally planar lower region of the channel for adhering to the profile of the head rail 116. The track 118 includes a series of apertures 120 formed therethrough such that the track 118 and head rail 116 may be fastened together by a plurality of fasteners or the like, preferably sheet metal screws.

Conventional head rails act as a horizontal reinforcing member in the structure of the stud wall. Accordingly, less material is required to manufacture the head rail 116 due to the additional support provided by the track 118. Furthermore, it may be conceived that the head rail 116 and track 118 may be unitarily formed in an H-shaped cross-section for reducing manufacturing costs and labor costs, and enhancing the overall horizontal reinforcing support of the stud wall 112. FIG. 13 illustrates that the stud wall employs wooden studs 114, however, the invention contemplates use of the anchor system 110 in conjunction with any stud wall including steel studs or the like.

The adjustability provided by the anchor system 111 is advantageous in light of the prior art solution which requires a wide assortment of bracketry for properly attaching the structural members 46 to the stud wall 112. Difficulties arise in the prior art due to the variation of spacing between structural members such as trusses and studs 114. For example, studs are typically constructed on sixteen inch centers and trusses or rafters are typically constructed on twenty-four inch centers. Accordingly, the prior art required at least two brackets for mounting the structural member 46 to the stud wall 114 dependent upon whether or not the structural members 46 were aligned or unaligned with the studs 112. The adjustability of the anchor system 111 overcomes these difficulties by allowing a user to secure structural members 46 to the stud wall 112 by using common anchor plates 52.

The invention contemplates that the anchor system 111 may be utilized for securing a panelized wall system rather than just structural members 46.

Figure 14:
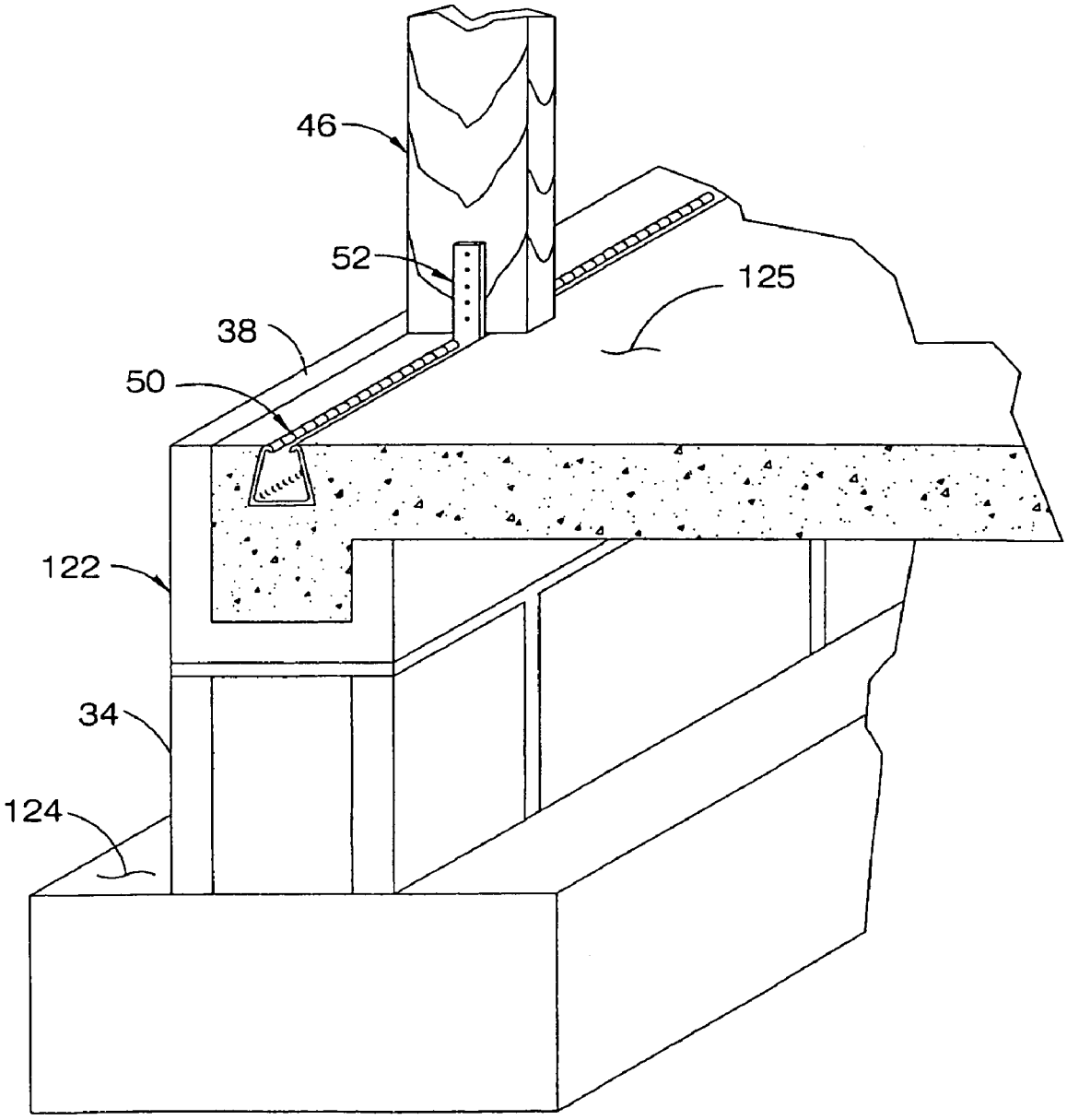
FIG. 14 is a perspective view of another alternative embodiment anchor system illustrated securing a structural member to a stem wall.

The present invention may be used to attach structural members 46 to a stemwall 122 as illustrated in FIG. 14. The stemwall 122 is similar to conventional masonry walls 32, however, the lintel blocks 38 are spaced relatively low in height from a foundation 124. The stemwall 122 includes a low number of rows of full blocks 34. Typically, only one row of full blocks 34 is employed as illustrated in FIG. 14. However, the invention contemplates the stemwall 122 may comprise more than one row of full blocks 34 or no rows of full blocks 34 at all. Lintel blocks 38 of the stemwall 122 typically have an elongate region of the U-shaped cross-section removed on a side inboard of the structure such that a flooring 125 may be poured of concrete 40 within the perimeter formed by the lintel blocks 38 and continuous across an area in which the stemwall 122 encloses. The structural members 46 that are attached to the stemwall 122 typically comprise upright wood or metal studs as illustrated in FIG. 14, however, the invention contemplates that any structural member 46 may be attached thereto.

Figure 15:
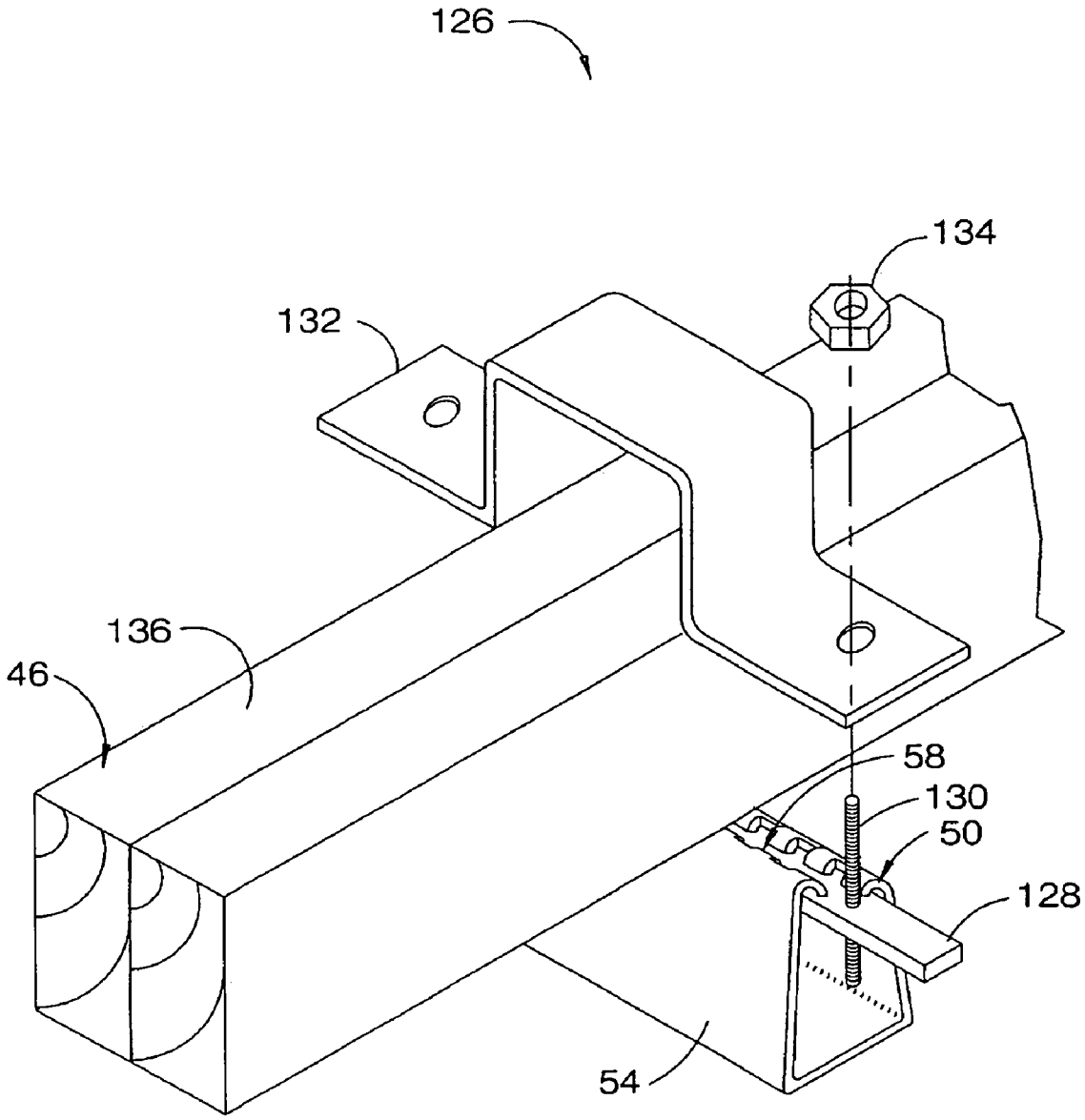
FIG. 15 is a perspective view of yet another exemplary embodiment anchor system in accordance with the present invention.

Referring now to FIG. 15, an alternative embodiment anchor system 126 is illustrated for attaching structural members 46 to a wall. The anchor system 126 includes a track 50 in accordance with the present invention that may be either embedded within concrete 40 or attached to a head rail 116. An insert 128 is sized to pass between the sidewalls 54 of the track 50 at a first orientation. The insert is defined as an elongate piece of steel having a width greater than that of the opening 58 of the track 50, and having a thickness narrower than the opening 58. Accordingly, the first orientation of the insert 128 is such that the insert 128 is positioned longitudinally with respect to the track 50 with its thickness aligned vertically for passing through the opening 58. Further, the insert is positioned at a second orientation such that the sidewalls 54 of the track 50 contact the insert 128 proximate to its width for retaining the insert 128 therein. The insert 128 is threadably engaged with a plurality of fasteners 130 for attaching an anchor strap 132 thereto by a threaded nut 134 or the like.

Although this anchor system 126 is more expensive than the aforementioned embodiments, including more components, some of which require costly manufacturing processes such as machining, this anchor system 126 may be preferred for attaching structural members that withstand the most extreme loads, such as girders 136, as illustrated.

The invention contemplates that the inserts 128 may be any form of elongate stock, fasteners, nuts or the like that are sized to pass between the sidewalls 54 at a first orientation and are sized to fit within the channel 56 and engage the sidewalls 54 at a second orientation such that the inserts 128 are retained at selected longitudinal positions with respect to the track 50 for the attachment of structural members 46.

The anchor system 48 of the present invention comprises a track for providing adjustable attachment of structural members and defining a horizontal reinforcing bar of the structural wall. Accordingly, the track spans the overall length or perimeter of the wall to provide the utmost adjustability and properly distribute loads throughout the wall to the vertical reinforcing bars. In order to provide convenience in manufacturing and lower the costs of the tracks of the anchor system, the tracks are manufactured at standard nominal lengths. The tracks may be customized to the length at the job site during installation by cutting the tracks to the required lengths. However, the standard track length may not be long enough to encompass an overall length of a wall. Therefore, where individual track pieces abut one another, a track splice 138 is provided for connecting abutting track pieces.

Figure 16:
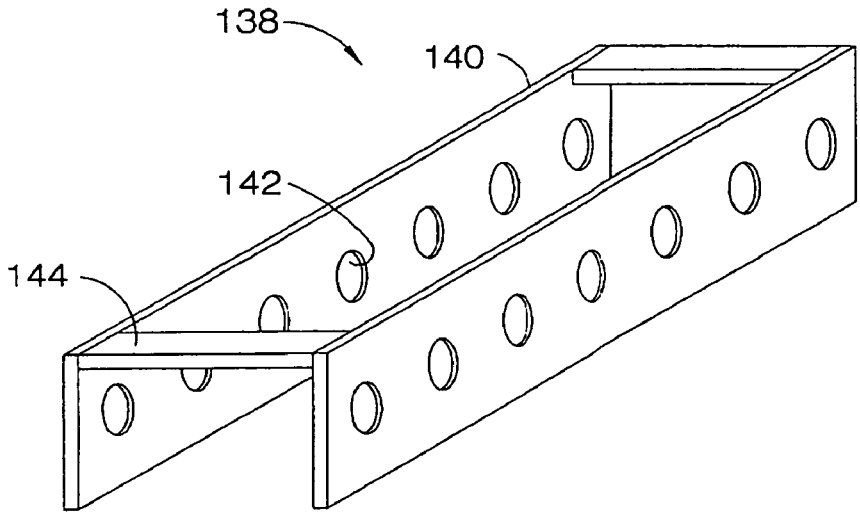
FIG. 16 is a perspective view of an exemplary splice in accordance with the present invention.

A track splice 138, shown in FIG. 16 comprises a pair of sidewalls 140 including a plurality of apertures 142 formed therethrough. The pair of sidewalls 140 are spaced apart and connected together by a pair of straps 144 formed at both ends of the track splice 138. The track splice 138 is manufactured of sheet steel or the like by cold-formed processes from a unitary piece or from individual pieces welded or fitted together.

Figure 17:
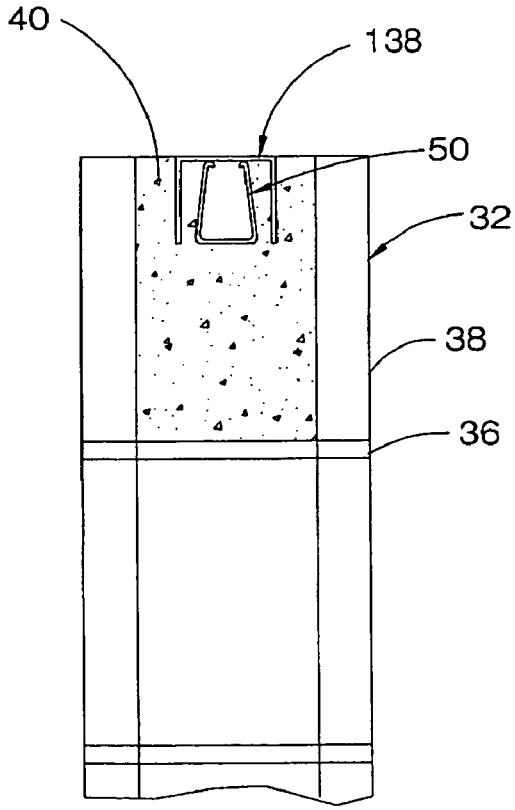
FIG. 17 is a side elevation section view of the anchor system of FIG. 2 in cooperation with the splice of FIG. 16.

Referring now to FIG. 17, the track splice 138 is illustrated in cross-section cooperating with a track 50 embedded within a masonry wall 32. The track splice 138 is aligned with abutting track pieces such that the abutment of the track pieces aligns with a mid-point of the track splice 138. The concrete 40 seeps through the apertures 142 in the track splice 138 such that the concrete 40 mechanically interlocks with the track splice 138. The abutting track pieces are connected in a region with the track splice 138 such that the terminating end of each track piece is anchored within the concrete and anchored to a track splice 138. Tension distributed through track 50 is translated to the connections of the track pieces within the concrete and is enhanced for tensile support by the track splice 138.

Figure 18:
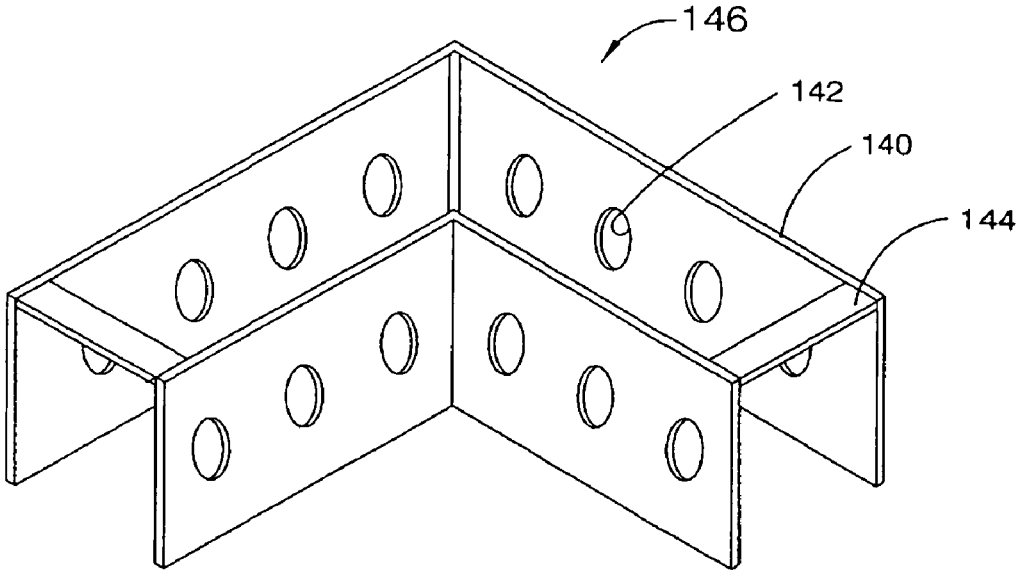
FIG. 18 is a perspective view of another exemplary splice in accordance with the present invention.

A similar track splice is used for a corner connection of track pieces as illustrated by corner splice 146 in FIG. 18. The corner splice 146 is formed by generally two track splices mitered together by cold-forming and/or welding processes. The corner splice 146 provides similar advantages and benefits of the track splice 138.

Figure 19:
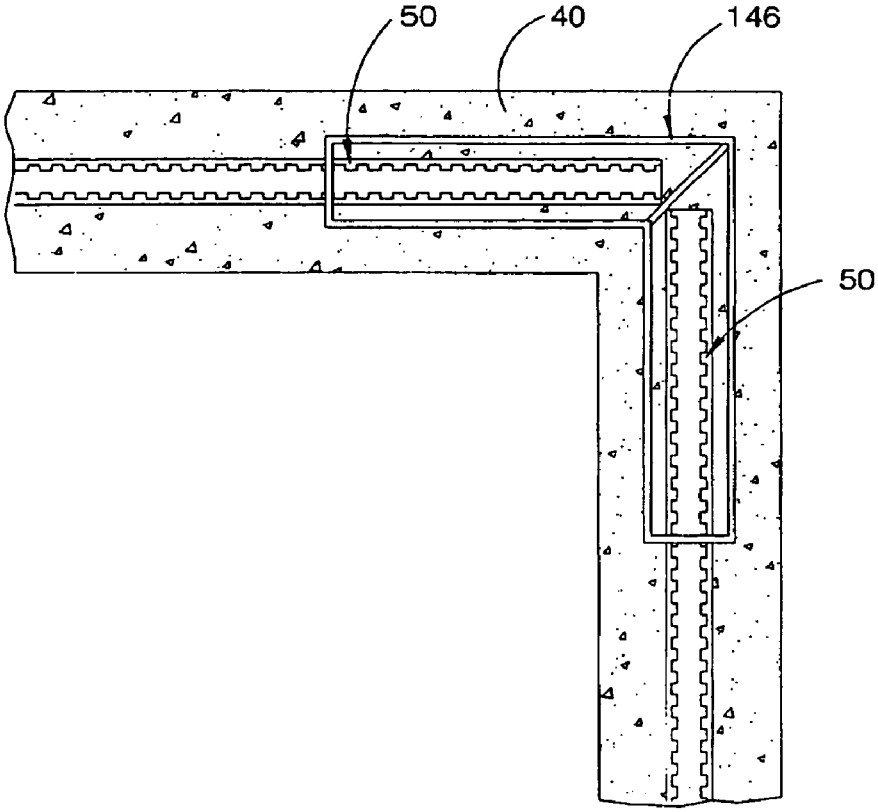
FIG. 19 is a top plan view of the anchor system of FIG. 2 in cooperation with the exemplary splice of FIG. 18 at a corner of a masonry wall.

Accordingly, the corner splice 146 is illustrated embedded within concrete with two terminating ends of track pieces at a corner of the wall 32 as illustrated in the plan view of FIG. 19. The individual track pieces terminate at ends proximate to each other.

Figure 20:
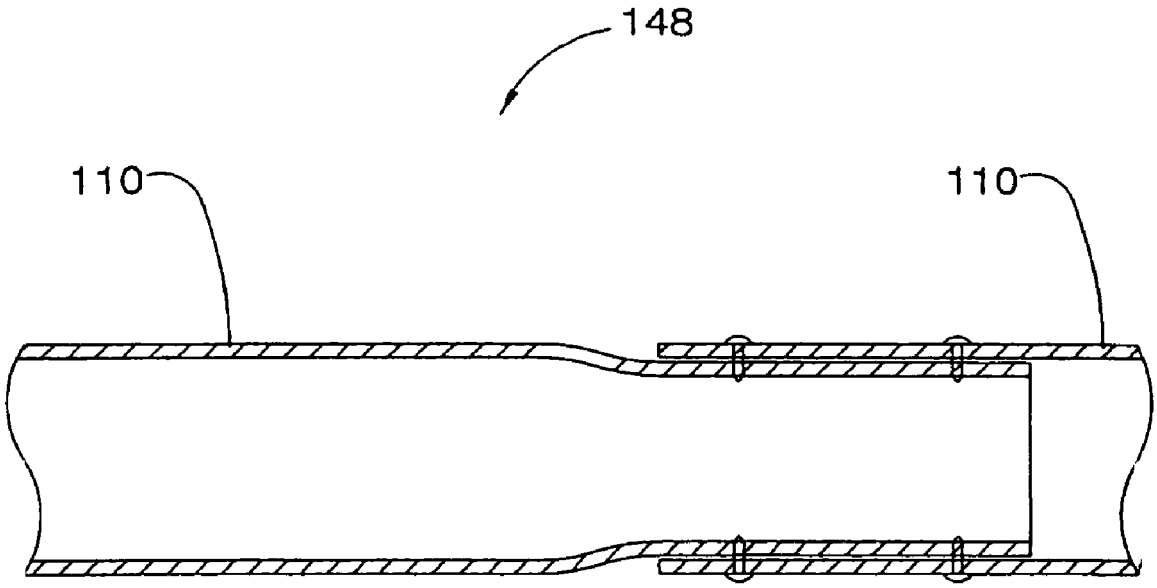
FIG. 20 is a top plan section view of an exemplary splice in accordance with the present invention.

An alternative embodiment splice 148 is illustrated in FIG. 20 wherein terminal ends of track pieces are sized to receive one another and fasten together by a fastener such as a sheet metal screw, a rivet or the like. One end may be tapered inwards or the other end may be widened outwards by a cold-forming process such that the ends are connectable. This type of splice is preferred for joining semi-circular track pieces 110 of anchor system 109 illustrated in FIG. 12.

To prevent concrete from seeping within the channel 56 of the track a cover (not shown) is affixable to the track 50 for covering the opening 58 and preventing concrete 40 from seeping therethrough. The cover may be an individually formed piece of plastic or spring steel that snaps in during installation and is removed once the concrete 40 has set. Such a cover is costly to manufacture and is labor intensive. Alternatively, the cover may be a thin piece of tape or adhesive strip applied across the opening 58 of the track 50 for preventing concrete from passing therethrough. The tape cover may be resilient enough to withstand concrete from passing within and may be weak enough to be easily penetrated by the insertion of an anchor plate 52.

Although covers may adequately prevent concrete 40 from entering the track 50, it is ideal to prevent elements from collecting therein. In the instance of a faulty or leaking roof, or a similar problematic event, it would be misfortunate if precipitation collected within the track 50. The precipitation may be inviting to insects and may have a tendency to freeze causing damage to the structure. Accordingly, a low density foam may be dispensed within the channel 56 for preventing concrete 40 or water from seeping through the opening 58 of the track 50. The foam would have a density low enough that a user can insert an anchor plate 52 within the foam and easily compress the foam within the track 50 while adjusting the positioning of the anchor plate 52.

Figure 21:
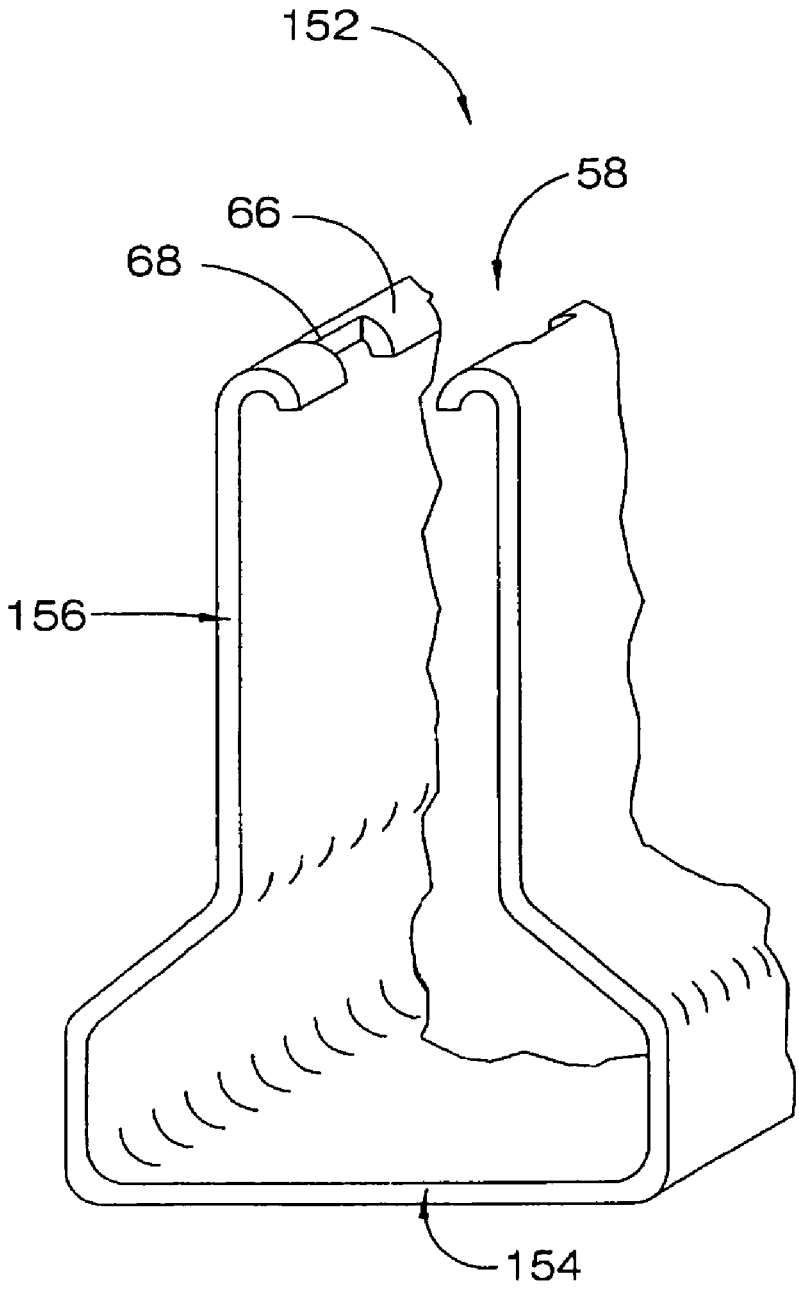
FIG. 21 is a partially broken perspective view of an exemplary track in accordance with the present invention.
Figure 22:
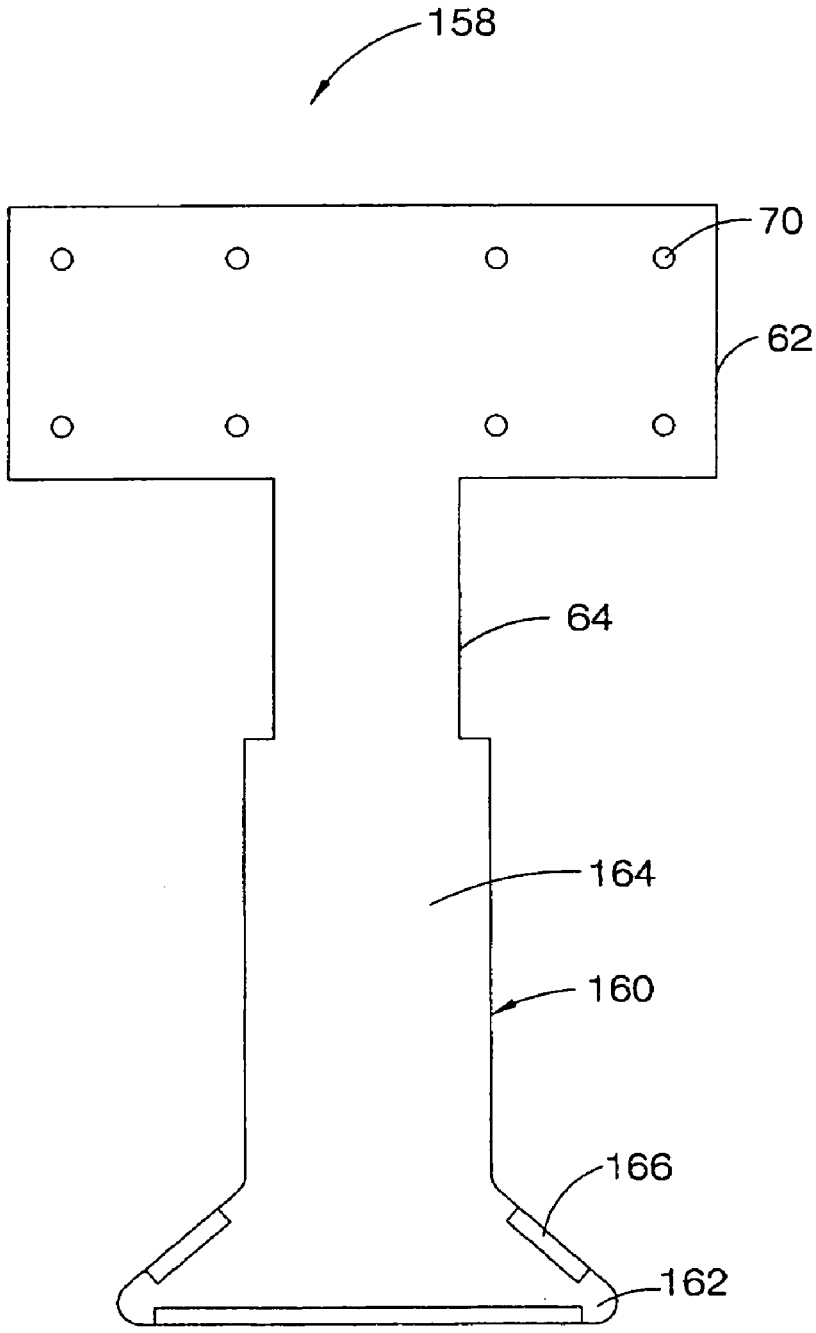
FIG. 22 is a side elevation view of an anchor plate in accordance with the present invention.
Figure 23:
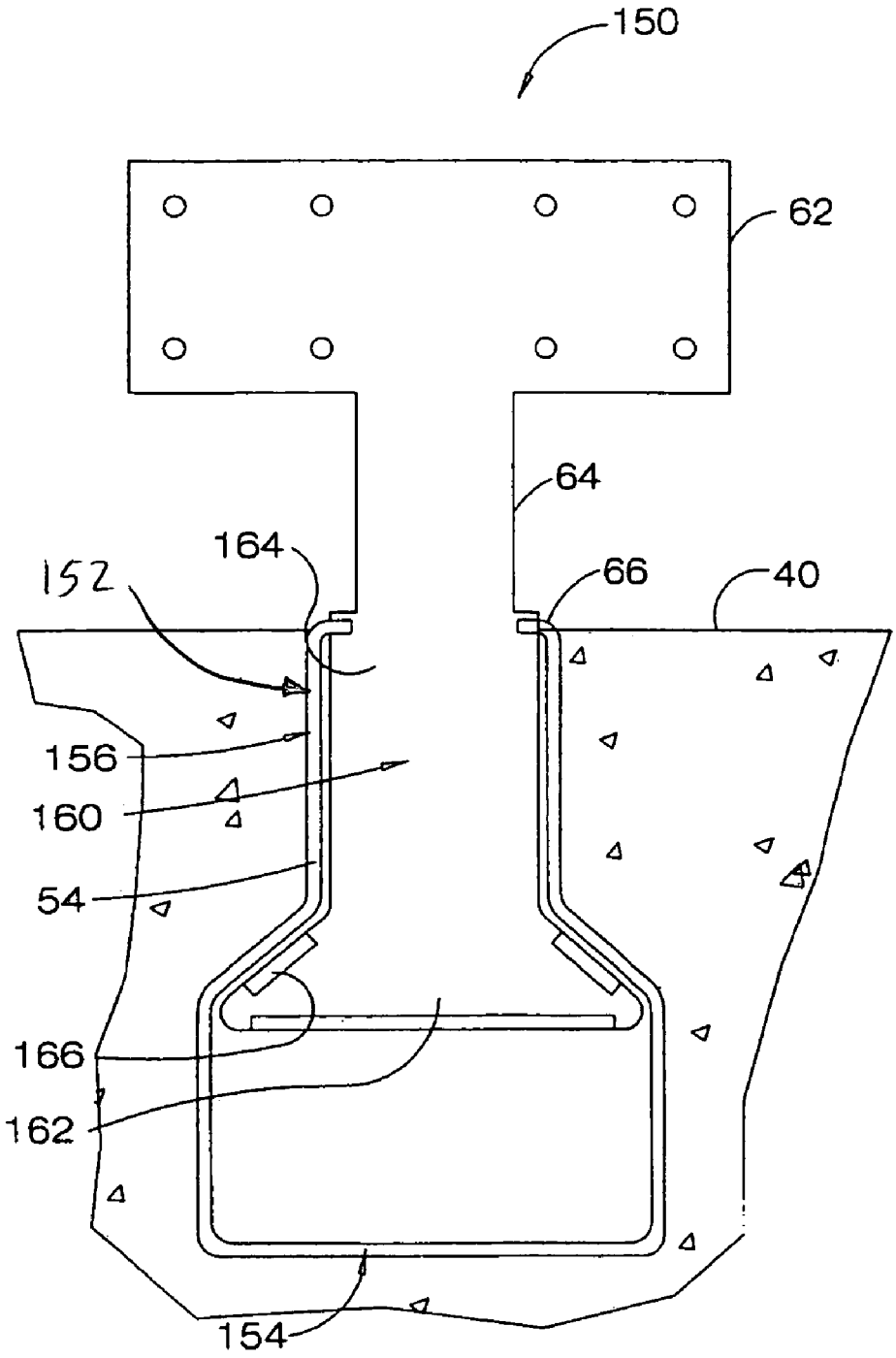
FIG. 23 is a side elevation section view of a preferred embodiment anchor system.

Referring now to FIGS. 21-23, a preferred embodiment anchor system 150 is illustrated for securing structural members 46 to a wall. The anchor system 150 provides maximum strength and is simple to manufacture. The anchor system 150 includes a track 152 illustrated in FIG. 21. The track 152 includes a lower region and an upper region defining respectively a lower channel 154 and an upper channel 156. The lower channel 154 has a width greater than the upper channel 156 for enhancing the anchoring of the track 152 within the concrete 40. The widened lower region 154 performs similar to the flange 78 of the tracks 76, 80 illustrated in FIGS. 5 and 6.

The track 152 has advantageous characteristics of resisting uplift forces transmitted thereupon by an anchor plate 158 illustrated in FIG. 22. The anchor plate 158 includes an enlarged head portion 160 having a lower tapered portion 162 and an upper portion 164. The lower tapered portion 162 has a width greater than that of the upper portion 164 and also greater than the width of the upper channel 156. Accordingly, the features of the anchor plate 158 provide that the anchor plate 158 may be inserted within the opening 58 of the track 152 at an orientation wherein the anchor plate 158 is generally parallel with the length of the track 152. The anchor plate 158 is inserted into the track 152 such that the lower portion 162 is inserted within the lower channel 154 and the upper portion 164 is oriented within the upper channel 156. Subsequently, the anchor plate 158 is rotated approximately 90 degrees and oriented with respect to the track 152 such that the anchor plate 158 is adjacent to a user selected position for attaching a structural member 46 and the nailing plate 62 is normal to the length of the track 152. Further, the anchor plate 158 is raised to a position such that the anchor plate 158 engages a track piece 152 as illustrated in FIG. 23, and the nailing plate 62 is fastened to the structural member 46 not shown.

The engagement of the anchor plate 158 and the track 152 is described with reference to FIG. 23. Due to the lower portion 162 having a width greater than the upper channel 156, the lower portion 162 engages the side walls 54 in the raised position and retains the anchor plate through this contact. It is preferred that this contact is located deep within the concrete 40 such that the track 152 is further reinforced and the uplift forces are counteracted by compressive loads applied within the concrete 40. Unlike prior embodiments, the resistance to uplift forces is not limited by the strength of the lips 66, rather the resistance of the anchor system 150 is a function of the strength of the track piece 152 and the supporting concrete 40 formed thereabout.

For enhancing the strength of the anchor plate 158, the lower portion 162 includes a plurality of lips 166 formed thereabout.

Similar to prior embodiments, the track 152 includes a pair of lips 66 formed in the side walls 54 having a series of incrementally spaced recesses 68 formed therein. Accordingly, the upper portion 164 of the enlarged head portion 160 is sized to fit within a pair of opposing recesses 68 for retaining the anchor plate 158 in a longitudinal position with respect to the track 152. From a manufacturing standpoint, the lips 66 and recesses 68 are formed about the opening 58 of the track piece 152 because this is the easiest location to form these features without effecting the strength of the track 152, nor requiring additional steps in manufacturing. Also, it is ideal that the recesses are formed at a location viewable to a user for aiding in the positioning or incremental spacing of anchor plates 158.

From the foregoing, it will be appreciated that the invention provides a relatively low-cost solution that overcomes the deficiencies of known anchoring systems for attaching structural members to walls.

While exemplary embodiments of the invention have been illustrated and described, it is not intended that the above description illustrates and describes all possible forms of the invention. Rather, the words used in the specification are words of description rather than limitation, and it is understood that various changes may be made without departing from the spirit and the scope of the invention.

What is claimed is:

1. An anchor system for attaching a series of structural members to a wall, the anchor system comprising:

a wall having a concrete filled upper region;

an elongate horizontal track having a pair of spaced apart sidewalls defining therebetween an outwardly facing channel with a restricted opening, and having a generally uniform cross-section configured for securing the track to a wall; and a plurality of inserts sized to pass between the sidewalls at a first orientation with respect to the track, and sized to fit within the channel and engage the sidewalls to retain the inserts at selected longitudinal positions at a second orientation with respect to the track, the inserts being adapted for attaching structural members thereto;

wherein the track is disposed within the concrete filled upper region of the wall such that the channel is embedded within the concrete for securing the track therein and the opening faces upward and out of the concrete; and wherein the track has a length for providing adjustability of the inserts continuously along the length of the wall, and the track defines a horizontal reinforcing member of the wall for distributing uplift loads from the structural members along the length of the wall.

2. The anchor system of claim 1, wherein the track has a generally U-shaped cross-section.

3. The anchor system of claim 1, wherein the track has a generally semi-circular cross-section.

4. The anchor system of claim 1, wherein abutting tracks are joined together by a splice.

5. The anchor system of claim 1, wherein the inserts are adapted to secure girders to the track at selected positions therealong.

6. The anchor system of claim 1, wherein the plurality of inserts further comprise a plurality of anchor plates each having an enlarged head portion, a nailing plate adapted for securing a structural member thereto and a relatively narrow strap extending between the head portion and the nailing plate, wherein the head portion is sized to fit with the channel and engage the sidewalls to retain the anchor plates at selected longitudinal positions, and the strap is sized to pass between the sidewalls to position the nailing plate generally normal to the track.

7. The anchor system of claim 6, wherein each sidewall includes a lip having a series of incrementally spaced recesses formed therealong for engaging the head portion of each anchor plate.

8. The anchor system of claim 6, wherein each head portion includes a lip for reinforcing the engagement of the anchor plate and the track.

9. The anchor system of claim 6, wherein the nailing plates each include a plurality of apertures adapted for fastening the anchor plate to a structural member.

10. The anchor system of claim 6, wherein each nailing plate includes at least one bend such that the anchor plate is adapted to contact at least two planar surfaces of a structural member for improving the attachment of the structural member to the track.

11. The anchor system of claim 6, wherein each of the anchor plates are adapted to secure beams to the track at selected positions therealong.

12. The anchor system of claim 6, wherein the anchor plates are adapted to secure joists, for supporting a floor or ceiling, to the track at selected positions therealong.

13. The anchor system of claim 6, wherein the anchor plates are adapted to secure trusses, for supporting a roof, to the track at selected positions therealong.

14. The anchor system of claim 6, wherein the anchor plates are adapted to secure rafters, for supporting a pitched roof, to the track at selected positions therealong.

15. The anchor system of claim 6, wherein the anchor plates are adapted to secure studs to the track at selected positions therealong.

16. The anchor system of claim 6, wherein the track includes a lower region and an upper region defining respectively a lower channel and upper channel, wherein the narrow strap is disposed through the upper channel and the lower channel has a width greater than the upper channel for receiving and engaging the enlarged head portion for retaining the anchor plate therein.

17. The anchor system of claim 1, wherein the track is connected to a vertical reinforcing bar disposed within the concrete of the wall.

18. The anchor system of claim 1, wherein the track has a cross section to anchor the track within the concrete.

19. The anchor system of claim 1, wherein the track has a cross section to anchor the track within the concrete.

20. The anchor system of claim 1, wherein the sidewalls are tapered such that the opening is narrow with respect to a lower region of the channel for anchoring the track within the concrete.

21. The anchor system of claim 1, wherein the track includes a pair of lateral flanges displaced along each sidewall for anchoring the track within the concrete.

22. The anchor system of claim 1, wherein the track includes a longitudinal flange spaced apart from the sidewalls by a longitudinal web for anchoring the track within the concrete.

23. The anchor system of claim 1, wherein the wall further comprises a masonry wall.

24. The anchor system of claim 1, wherein the wall further comprises a concrete wall.

25. The anchor system of claim 1, wherein the track further comprises separate track pieces that spliced together at abutting ends of the track pieces so that the length of the track is formed structurally continuous.

26. The anchor system of claim 1, wherein the track includes a series of apertures sized to allow concrete to seep therethrough for mechanically interlocking the track and the concrete.

27. An anchor system for attaching a series of structural members to a wall, the anchor system comprising:

an elongate horizontal track having a pair of spaced apart sidewalls defining therebetween an outwardly facing channel with a restricted opening; and a plurality of anchor plates each having an enlarged head portion, a nailing plate adapted for securing a structural member thereto and a relatively narrow strap extending between the head portion and the nailing plate, wherein the head portion is sized to fit within the channel and engage the sidewalls to retain the anchor plates at selected longitudinal positions, and the strap is sized to pass between the sidewalls to position the nailing plate generally normal to the track;

wherein the track is adapted to be disposed within a concrete filled upper region of a wall such that the channel is adapted to be embedded within the concrete for securing the track therein and the opening faces upward and out of the concrete, and the track includes a longitudinal web including a series of apertures sized to allow concrete to seep therethrough for mechanically interlocking the track and the concrete.

28. An anchor system for attaching a series of structural members to a wall, the anchor system comprising:

a wall having a concrete filled upper region;

an elongate horizontal track having a pair of spaced apart sidewalls defining therebetween an outwardly facing channel with a restricted opening; and a plurality of anchor plates each having an enlarged head portion, a nailing plate adapted for securing a structural member thereto and a relatively narrow strap extending between the head portion and the nailing plate, wherein the head portion is sized to fit within the channel and engage the sidewalls to retain the anchor plates at selected longitudinal positions, and the strap is sized to pass between the sidewalls to position the nailing plate generally normal to the track;

wherein the track is disposed within the concrete filled upper region of the wall such that the channel is embedded within the concrete for securing the track therein and the opening faces upward and out of the concrete;

wherein the track defines a reinforcing bar within the concrete of the wall for collectively distributing uplift loads from the series of structural members along the wall to tensile loads along the track; and wherein the track includes a longitudinal web including a series of apertures sized to allow concrete to seep therethrough for mechanically interlocking the track and the concrete.

* * * * *

UNITED STATES PATENT AND TRADEMARK OFFICE

CERTIFICATE OF CORRECTION

PATENT NO. : 7,237,368 B2
APPLICATION NO. : 10/154952
DATED : July 3, 2007
INVENTOR(S) : Richard B. Richardson et al.

It is certified that error appears in the above-identified patent and that said Letters Patent is hereby corrected as shown below:

Column 15, Lines 43-44, Claim 19:

Delete "has a cross section to anchor the track" and insert therefor -- mechanically interlocks --.

Signed and Sealed this

Sixth Day of November, 2007

JON W. DUDAS
*Director of the United States Patent and Trademark Office*